US009941064B2

(12) United States Patent
Hammer et al.

(10) Patent No.: US 9,941,064 B2
(45) Date of Patent: Apr. 10, 2018

(54) ON-LOAD TAP CHANGER, TAP-CHANGING TRANSFORMER FOR VOLTAGE REGULATION AND METHOD FOR IMPLEMENTING TAP CHANGER IN THE TAP-CHANGING TRANSFORMER

(71) Applicant: Maschinenfabrik Reinhausen GmbH, Regensburg (DE)

(72) Inventors: Christian Hammer, Regensburg (DE); Andreas Sachsenhauser, Mallersdorg-Pfaffenberg (DE); Konrad Raedlinger, Tegernheim (DE); Max Weidinger, Regensburg (DE); Thomas Schuster, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/906,331

(22) PCT Filed: Aug. 1, 2014

(86) PCT No.: PCT/EP2014/066634
§ 371 (c)(1),
(2) Date: Jan. 20, 2016

(87) PCT Pub. No.: WO2015/028253
PCT Pub. Date: Mar. 5, 2015

(65) Prior Publication Data

US 2016/0181024 A1 Jun. 23, 2016

(30) Foreign Application Priority Data

Aug. 27, 2013 (DE) ..... 10 2013 109 289
Mar. 14, 2014 (DE) ..... 10 2014 103 526

(51) Int. Cl.
*G05F 1/14* (2006.01)
*G05F 1/147* (2006.01)
(Continued)

(52) U.S. Cl.
CPC ..... *H01H 9/0027* (2013.01); *G05F 1/147* (2013.01); *H01F 29/02* (2013.01); *H01H 9/0011* (2013.01);
(Continued)

(58) Field of Classification Search
CPC ..... G05F 1/147; G05F 1/14; H01H 9/0011; H01H 9/0038; H01H 9/0033; H01H 9/0016; H01H 9/0027; H01F 29/02
See application file for complete search history.

(56) References Cited

U.S. PATENT DOCUMENTS 2,434,503 A 1/1948 McCarty
2,484,576 A 10/1949 Minneci
(Continued)

FOREIGN PATENT DOCUMENTS

EP 0213461 A 3/1987
GB 2424766 A 10/2006
WO 2012175141 A 12/2012

*Primary Examiner* — Timothy J Dole
*Assistant Examiner* — Sisay G Tiku
(74) *Attorney, Agent, or Firm* — Andrew Wilford

(57) ABSTRACT

In an on-load tap changer (10) for controlling voltage of a tapped transformer (15) it is provided that the tapped transformer (15) has at least one regulatable phase (16) that has a first winding (20) and a second winding (30);

the first winding (20) has a regulating winding (21) with even-numbered winding taps (23) and a main winding (22), and the second winding (30) has a regulating winding (31) with odd-numbered winding taps (33) and a main winding (32);

(Continued)

the first winding (20) and the second winding (30) having the regulating windings (21, 31) of the even-numbered and of the odd-numbered winding taps (23, 33), are inductively coupled;

the on-load tap changer (10) has a selector (40) for the alternating power-free preselection of the even-numbered or odd-numbered winding taps (23, 33) to be switched.

27 Claims, 16 Drawing Sheets

(51) Int. Cl.
*H01H 9/00* (2006.01)
*H01F 29/02* (2006.01)

(52) U.S. Cl.
CPC ..... *H01H 9/0016* (2013.01); *H01H 9/0038* (2013.01)

(56) References Cited

U.S. PATENT DOCUMENTS 3,530,358 A * 9/1970 Thompson ..... G05F 1/20 323/258
3,764,891 A * 10/1973 Lingenfelter ..... H01H 9/0027 200/11 TC
2013/0057248 A1* 3/2013 Albrecht ..... H01F 29/04 323/340
2013/0213776 A1* 8/2013 Hoepfl ..... H01H 9/0038 200/11 TC
2014/0027257 A1* 1/2014 Albrecht ..... H01F 29/04 200/5 R
2014/0034463 A1* 2/2014 Albrecht ..... H01F 29/04 200/11 TC
2014/0085028 A1* 3/2014 Hammer ..... H01F 29/04 336/150
2015/0027989 A1* 1/2015 Bieringer ..... H01H 9/0027 218/140
2015/0028978 A1* 1/2015 Bieringer ..... H01H 9/0027 336/150
2015/0091684 A1* 4/2015 Pankofer ..... H01H 9/0038 336/150
2015/0109085 A1* 4/2015 Weber ..... H01F 27/38 336/145
2015/0168965 A1* 6/2015 Baerthlein ..... G05F 1/14 323/340
2016/0018840 A1* 1/2016 Strof ..... G05F 5/00 323/301

* cited by examiner

ON-LOAD TAP CHANGER, TAP-CHANGING TRANSFORMER FOR VOLTAGE REGULATION AND METHOD FOR IMPLEMENTING TAP CHANGER IN THE TAP-CHANGING TRANSFORMER

CROSS REFERENCE TO RELATED APPLICATIONS

This application is the US-national stage of PCT application PCT/EP2014/066634 filed 1 Aug. 2014 and claiming the priority of German patent application 102013109289.6 itself filed 27 Aug. 2013 and German patent application 102014103526.7 itself filed 14 Mar. 2014.

FIELD OF THE INVENTION

The invention relates to an on-load tap changer for controlling voltage of a tapped transformer, in particular for a tapped transformer that has at least one phase to be regulated and that has a first winding and a second winding, to a tapped transformer for voltage regulation as well as to a method of switching a tapped transformer for voltage regulation.

BACKGROUND OF THE INVENTION

Different types of transformers are being used in the area of energy supply. Besides the widely used transformers that are immersed in oil, there are also dry-type transformers. In dry-type transformers, a resin and the surrounding air have to assume the insulating and cooling functions of the oil. Since the oil fulfills these functions many times better, the performance ranges of the different transformer types are correspondingly different.

At the present time, large numbers of people are migrating to inner city areas to settle there. Accordingly, the energy supply has to be adapted to this development. Oil-filled transformers always involve the risk of a transformer fire, which would have devastating consequences in a densely populated area. A lively interest is therefore taken in the development of different dry-type transformers and the associated regulation devices.

A tapped transformer in which each phase consists of two windings is known from EP 0 213 461 B1. These windings each have two coupled-together sections with taps. A load selector, a so-called integrated on-load tap changer, is connected with the taps such that the load selector first connects the taps of the one winding and then those of the other winding. This applies likewise for disconnecting the taps. The switching from one tap to a next tap is performed in one step. The actual switching is carried out by a contact system with three contacts and two transition resistors. This embodiment has the following disadvantages:

First, all taps of the one winding part are switched on or off and afterward those of the other winding part. This results in an undesired magnetic imbalance of the transformer.

Loss of contact material due to commutation of the load current occurs at dissipation contacts and sliding contacts on moving across the middle position.

The switching step in switching across the middle position results in no change in voltage in the transformer.

The entire regulation range of the voltage of the transformer occasionally occurs between the step contacts and dissipation contacts. This means that large distances are required for high voltages.

The object of the invention is therefore to provide an on-load tap changer for voltage regulation that avoids the disadvantages of the prior art and can be used for higher voltages, a tapped transformer for voltage regulation that is safe and reliable, as well as a method of switching a tapped transformer for voltage regulation to ensure safe operation of the tapped transformer.

This object is attained according to a first aspect of the invention with an on-load tap changer for controlling voltage of a tapped transformer wherein the tapped transformer has at least one phase to be regulated that has a first winding and a second winding;

the first winding has a regulating winding with even-numbered winding taps and a main winding, and the second winding has a regulating winding with odd-numbered winding taps and a main winding;

the first winding and the second winding having the regulating windings of the even-numbered and of the odd-numbered winding taps, are inductively coupled;

the on-load tap changer has a selector, in particular a first selector, for the alternating power-free preselection of the even-numbered or odd-numbered winding taps to be switched.

The on-load tap changer proposed according to the first aspect of the invention serves for controlling voltage of a tapped transformer. The tapped transformer has at least one phase to be regulated that has a first winding and a second winding. The first winding in each case has a regulating winding with even-numbered winding taps, and the second winding has a regulating winding with odd-numbered winding taps. One main winding is moreover provided, wherein the first winding and the second winding having the regulating windings of the even-numbered and of the odd-numbered winding taps, are inductively coupled. The on-load tap changer has a selector, in particular a first selector constructed such that an alternating power-free preselection of the even-numbered or odd-numbered winding taps to be switched is possible.

It can be provided that the selector has a first selector part for the regulating winding with the even-numbered winding taps and a second selector part for the regulating winding with the odd-numbered winding taps for the power-free preselection of the winding taps to be switched.

It can be provided that each of the proposed on-load tap changers comprises a load-diverter switch, in particular a first load-diverter switch, for carrying out the switching between the even-numbered or the odd-numbered winding taps of the regulating windings preselected load-free by the selector.

The selector has a first selector part for the regulating winding with the even-numbered winding taps and a second selector part for the regulating winding with the odd-numbered winding taps for the power-free preselection of the winding taps to be switched. For carrying out the switching, a load-diverter switch, in particular a first load-diverter switch, is provided between the even-numbered or the odd-numbered winding taps, and the load-diverter switch switches over between the regulating windings preselected load-free by the selector.

It can be provided that the first selector part and the second selector part each have two selector arms for the winding taps of a regulating winding.

It can be provided that the first selector part is electrically conductively connected with the even-numbered winding taps of the regulating winding of the first winding via step contacts;

the second selector part is electrically conductively connected with the odd-numbered winding taps of the regulating winding of the second winding via step contacts.

It can be provided that each selector arm is electrically conductively connected with a respective dissipation rail and with a respective step contact of the corresponding regulating winding;

each dissipation rail is electrically conductively connected with the load-diverter switch.

It can be provided that each selector arm is assigned a spindle, a belt, or a chain for linear movement.

The first selector part has two respective selector arms, and the second selector part has two respective selector arms formed for the winding taps of a regulating winding. The first selector part is electrically conductively connected with the even-numbered winding taps of the regulating winding of the first winding via step contacts. The second selector part is electrically conductively connected with the odd-numbered winding taps of the regulating winding of the second winding via step contacts. Each selector arm of the first or the second selector part is electrically conductively connected with a respective dissipation rail and with a respective step contact of the corresponding regulating winding. Each dissipation rail is electrically conductively connected with the load-diverter switch. Each selector arm is assigned a spindle, a belt, or a chain for linear movement.

It can be provided that the load-diverter switch has a first switching side and a second switching side;

the first switching side disconnects or connects the first dissipation rail of the first selector part and the second dissipation rail of the second selector part;

the second switching side disconnects or connects the second dissipation rail of the first selector part and the first dissipation rail of the second selector part.

The load-diverter switch has a first switching side and a second switching side, with the first switching side disconnecting or connecting the first dissipation rail of the first selector part and the second dissipation rail of the second selector part. Likewise, the second switching side disconnects or connects the second dissipation rail of the first selector part and the first dissipation rail of the second selector part.

In one embodiment of the on-load tap changer, each switching side has at least one mechanical switch, two vacuum switching tubes and one resistor. The mechanical switch is connected in series with a first switching branch with a vacuum switching tube and with a parallel second switching branch with a vacuum switching tube and a resistor connected in series therewith.

In a further embodiment of the on-load tap changer, each switching side has at least one mechanical switch, two vacuum switching tubes and one resistor. A first switching branch is connected in parallel to a second switching branch, with the first switching branch having a mechanical switch and a vacuum switching tube connected in series and the second switching branch having a mechanical switch, a vacuum switching tube, and a resistor connected in series.

In a further embodiment of the on-load tap changer, each switching side has at least one mechanical switch, two vacuum switching tubes and one resistor. The mechanical switch is connected in series with a vacuum switching tube and is connected in series with a first switching branch with a resistor and with a second switching branch with a vacuum switching tube, with the first and the second switching branch being connected in parallel.

It can be provided that each switching side has a permanent main contact connected in parallel to the first and the second switching branch.

It can be provided that each switching side has a permanent main contact that directly conductively disconnects from each other or conductively connects with each other the first and the second dissipation rail.

Each switching side has a permanent main contact connected in parallel to the first and second switching branch. Furthermore, each switching side has a permanent main contact that directly conductively connects the first and the second dissipation rail with each other.

Each switching side can be formed in any manner as required and can comprise, for instance, at least one additional or further mechanical switch and/or at least one additional or further vacuum switching tube and/or at least one additional or further resistor and/or at least one additional or further permanent main contact.

It can be provided that each of the proposed on-load tap changers comprises a motor drive, in particular a first motor drive coupled to the selector and/or to the load-diverter switch.

It can be provided that each of the proposed on-load tap changers comprises a driven shaft, in particular a first driven shaft that couples the motor drive to the selector and/or to the load-diverter switch; and/or a transmission, in particular a first transmission that couples the motor drive to the driven shaft or to the selector and/or to the load-diverter switch; and/or a drive shaft, in particular a first drive shaft that couples the motor drive to the transmission.

The coupling of the first motor drive to the first selector and/or to the first load-diverter switch can be performed in any manner as required, for instance directly or indirectly, in particular via the driven shaft and/or the transmission and/or the drive shaft. In direct coupling, the first motor drive is preferably arranged as close as possible to the first selector and/or to the first load-diverter switch and/or fixed to the first selector and/or to the first load-diverter switch.

Preferentially, each shaft can be electrically insulating.

It can be provided that each of the proposed on-load tap changers comprises an electrically insulating post with an upper post end and a lower post end that can be or is fixed to a base at ground potential;

with the selector being fixed to the upper post end and arranged above the upper post end.

The post, which is also referred to as support, provides the insulation spacing required in the respective application instance, between the contacts, wires, and other parts of the on-load tap changer that are under voltage, and the ground potential. An insulation spacing of at least 72 kV or at least 123 kV or at least 145 kV can thus be achieved with sufficient height of the post.

The base can be, for instance, a part of the tapped transformer or of the on-load tap changer.

The on-load tap changer proposed according to the first aspect can be formed in any manner as required and can comprise, for instance, at least one additional or further selector and/or at least one additional or further load-diverter switch and/or at least one additional or further motor drive and/or at least one additional or further driven shaft and/or at least one additional or further transmission and/or at least one additional or further drive shaft and/or at least one additional or further post.

It can be provided that the load-diverter switch is fixed to the upper post end and arranged above the upper post end, in particular below the selector; and/or the transmission is fixed to the upper post end and arranged above the upper post end, in particular below the selector and/or above the resistors, or fixed to the lower post end and arranged below the lower post end, in particular in the base; and/or the motor drive is fixed to the lower post end and arranged below the lower post end; and/or the drive shaft or the driven shaft runs through the post from the lower post end to the upper post end.

It can be provided that at least one of the resistors is a cast iron resistor.

In each switching process, the resistors are loaded with very high electrical power and heat up accordingly. They can cool off until the next switching process, but, according to the switching interval, this can be so short that they continue to increasingly heat up. If their temperature is too high, the switching interval has to be increased in order to provide more time for cooling off. This impairs the operation of the on-load tap changer. In comparison to wire resistors, such cast iron resistors have higher masses and thus heat up slower under the same energy input so that the switching interval has to be less frequently increased. This is significant in particular for dry-type transformers because their resistors are cooled with air, which is by far less effective than the cooling by means of the transformer oil, which is possible in oil transformers.

Preferably, the hot exhaust air accruing from the cooling of a dry-type transformer by means of air can be used as cooling air for the resistors, since this hot exhaust air is still cooler than the resistors under operation are.

It can be provided that each of the proposed on-load tap changers comprises a second selector for a second phase to be regulated of the tapped transformer;

a third selector for a third phase to be regulated of the tapped transformer;

with the second and the third selector being formed, in particular, like the first selector;

the second and the third phase being formed, in particular, like the first phase to be regulated;

the selectors being arranged at the corners of a triangle.

Such a three-phase on-load tap changer is suited, in particular, for a so-called temple-configuration transformer, in which the three phases are arranged symmetrically to each other at the corners of an equilateral triangle, and that is known from DE 40 29 097 A1, U.S. Pat. No. 5,202,664 A, EP 1 277 217 B1, EP 2 367 181 A1, and US 2013 328 652 A1, for instance. The three selectors can simply be assigned to the phases such that analog or similar or the same connection conditions exist for each phase-selector pair and, in particular, such that short connecting lines are possible. Instead of one such three-phase on-load tap changer, three one-phase on-load tap changers that are, in particular, formed according to the first aspect and/or identical in construction, can also be arranged symmetrically to each other at the corners of an equilateral triangle.

Preferably, the triangle is equilateral and the selectors at its corners are arranged symmetrically to each other.

It can be provided that each of the proposed on-load tap changers comprises a second load-diverter switch assigned to the second selector;

a third load-diverter switch assigned to the third selector;

with the second and the third load-diverter switch being formed, in particular, like the first load-diverter switch.

It can be provided that the motor drive is coupled to the second and the third selector and/or to the second and the third load-diverter switch.

It can be provided that each of the proposed on-load tap changers comprises a second driven shaft that couples the motor drive to the second selector and/or to the second load-diverter switch; and/or a third driven shaft that couples the motor drive to the third selector and/or to the third load-diverter switch; and/or a second transmission that couples the motor drive to the second driven shaft and to the second selector and/or to the second load-diverter switch; and/or a third transmission that couples the motor drive to the third driven shaft and to the third selector and/or to the third load-diverter switch; and/or a second drive shaft that couples the motor drive to the second transmission; and/or a third drive shaft that couples the motor drive to the third transmission.

It can be provided that each of the proposed on-load tap changers comprises a second motor drive coupled to the second selector and/or to the second load-diverter switch;

a third motor drive coupled to the third selector and/or to the third load-diverter switch;

with the second and the third motor drive being formed, in particular, like the first motor drive; and/or the couplings of the second and of the third motor drive to the respective selectors and/or load-diverter switches being performed, in particular, like the coupling of the first motor drive to the first selector and/or to the first load-diverter switch.

It can be provided that the motor drives are synchronized, in particular, by mechanical and/or electronic coupling.

According to a second aspect, the invention proposes a tapped transformer for voltage regulation, which tapped transformer comprises an on-load tap changer, in particular a first on-load tap changer formed, in particular, according to the first aspect, and at least one phase to be regulated that has a first winding and a second winding, wherein the first winding has a regulating winding with even-numbered winding taps and a main winding, and the second winding has a regulating winding with odd-numbered winding taps and a main winding;

the first winding and the second winding having the regulating windings of the even-numbered and of the odd-numbered winding taps, are inductively coupled;

the on-load tap changer has a first selector part and a second selector part for the alternating power-free preselection of the even-numbered or odd-numbered winding taps to be switched.

The tapped transformer for voltage regulation according to the second aspect of the invention comprises an on-load tap changer, in particular a first on-load tap changer formed, in particular, according to the first aspect, and at least one phase to be regulated that has a first winding and a second winding. The first winding has a regulating winding with even-numbered winding taps and a main winding. The second winding has a regulating winding with odd-numbered winding taps and a main winding. The first winding and the second winding having the regulating windings of the even-numbered and of the odd-numbered winding taps, are inductively coupled. The on-load tap changer has a first selector part and a second selector part for the alternating power-free preselection of the even-numbered or odd-numbered winding taps to be switched.

It can be provided that the first selector part and the second selector part each have two selector arms for the winding taps of each one of the regulating windings;

with each selector arm of the first or the second selector part being electrically conductively connected with a respective dissipation rail and with a respective step contact of the corresponding regulating winding;

with each dissipation rail being electrically conductively connected with the on-load tap changer.

The first selector part and the second selector part each have two selector arms for the winding taps of each one of the regulating windings. Each selector arm of the first or the second selector part is electrically conductively connected with a respective dissipation rail with a respective step contact of the corresponding regulating winding. Each dissipation rail is electrically conductively connected with the on-load tap changer.

It can be provided that a transmission, in particular a first transmission, is provided with a motor drive, in particular with a first motor drive, for activating the first selector part and the second selector part; and/or each on-load tap changer of each one of the phases is connected with a common motor drive; and/or the tapped transformer is a dry-type transformer.

A transmission, in particular a first transmission, is provided with a motor drive, in particular with a first motor drive, for effecting an activation of the first selector part and of the second selector part. Each on-load tap changer of each one of the phases is connected with a common motor drive. The tapped transformer is a dry-type transformer.

According to a first alternative, it can be provided that each of the proposed tapped transformers comprises a second and a third phase to be regulated that are formed, in particular, like the first phase to be regulated;

with the phases being arranged, in particular, symmetrically to each other at the corners of a first, in particular, equilateral triangle;

the on-load tap changer comprising a second selector for the second phase;

a third selector for the third phase;

the second and the third selector being formed, in particular, like the first selector;

the selectors being arranged at the corners of a second triangle.

Preferably, the second triangle is equilateral and the selectors at its corners are arranged symmetrically to each other. The symmetry axis of the second equilateral triangle is, in particular, coaxial to the symmetry axis of the first triangle.

According to a second alternative, it can be provided that each of the proposed tapped transformers comprises a second and a third phase to be regulated that are formed, in particular, like the first phase to be regulated;

a second on-load tap changer for the second phase and a third on-load tap changer for the third phase, which on-load tap changers are formed, in particular, like the first on-load tap changer;

with the phases being arranged, in particular, symmetrically to each other at the corners of a first, in particular, equilateral triangle;

the on-load tap changers being arranged at the corners of a second triangle.

Preferably, the second triangle is equilateral and the on-load tap changers at its corners are arranged symmetrically to each other. The symmetry axis of the second equilateral triangle is, in particular, coaxial to the symmetry axis of the first triangle.

These tapped transformers according to the two alternatives are thus temple-configuration transformers and are similar to the temple-configuration transformers known from DE 40 29 097 A1, U.S. Pat. No. 5,202,664 A, EP 1 277 217 B1, EP 2 367 181 A1, and US 2013 328 652 A1, for instance. In these tapped transformers, the three on-load tap changers or the three selectors can simply be assigned to the phases such that analog or similar or the same connection conditions exist for each phase-on-load tap changer pair and, in particular, such that short connecting lines are possible.

In both alternatives, it can be provided that the tapped transformer comprises a motor drive for each phase, which motor drive is coupled to the respective selector and/or to the respective load-diverter switch;

with the motor drives being arranged at the corners of a third triangle.

Preferably, the third triangle is equilateral and the motor drives at its corners are arranged symmetrically to each other. The symmetry axis of the third equilateral triangle is, in particular, coaxial to the symmetry axis of the first equilateral triangle and/or to the symmetry axis of the second equilateral triangle.

A method proposed according to the third aspect of the invention for switching a tapped transformer for voltage regulation, which tapped transformer is, in particular, formed according to the third aspect, comprises the following steps:

load-free preselection of an even-numbered or odd-numbered winding tap to be switched, of a regulating winding of a first or a second winding;

switching to the preselected even-numbered or odd-numbered winding tap of the first or second winding by means of one single load-diverter switch.

It can be provided that the even-numbered or odd-numbered winding taps of a regulating winding of a first or a second winding are preselected and switched alternatingly.

The even-numbered or odd-numbered winding taps of a regulating winding of a first or a second winding are preselected and switched alternatingly.

The explanations and exemplifications regarding one of the aspects of the invention, in particular regarding individual features of this aspect, also apply correspondingly for the other aspects of the invention.

BRIEF DESCRIPTION OF THE DRAWING

In the following, embodiments of the invention are explained in detail by means of the attached drawings. The individual features thereof are, however, not limited to the individual embodiments but can be connected and/or combined with individual features described further above and/or with individual features of other embodiments. Each example in the illustrations is provided by explanation, not limitation of the invention. In the drawing.

SPECIFIC DESCRIPTION OF THE INVENTION

Figure 1:
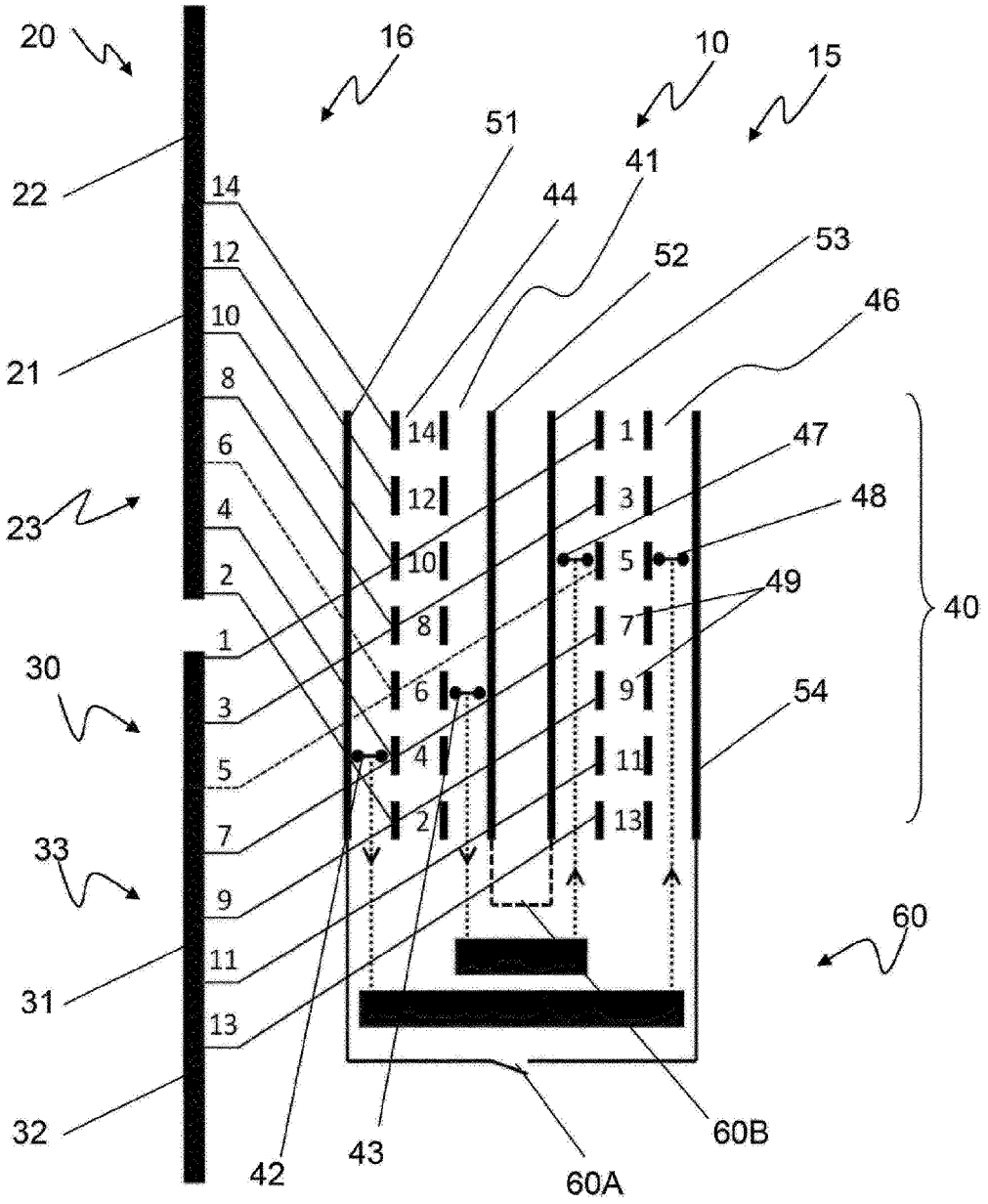
FIG. 1 shows a first embodiment of a tapped transformer with an on-load tap changer in a first embodiment.

The same or equivalent elements of the invention are designated by identical reference characters. Furthermore and for the sake of clarity, only the reference characters relevant for describing the respective figure are provided. It should be understood that the detailed description and specific examples of the tapped transformer with on-load tap changer according to the invention are intended for purposes of illustration only and are not intended to limit the scope of the invention.

FIG. 1 shows a schematic illustration of a first embodiment of a tapped transformer 15 with an on-load tap changer 10 in a first embodiment. The tapped transformer 15 commonly has three phases 16, 17, 18, of which only a first phase 16 is illustrated here. Each phase 16, 17, 18 consists of a first winding 20 and a second winding 30 that are inductively coupled with each other. The first winding 20 consists of a regulating winding 21 and a main winding 22. The regulating winding 21 has even-numbered winding taps 23. The second winding 30 also has a regulating winding 31 and a main winding 32. The regulating winding 31 of the second winding 30 has odd-numbered winding taps 33.

The on-load tap changer 10 has a selector 40 and a load-diverter switch 60. The first selector 40 consists of a first selector part 41 and a second selector part 46 that are both constructed linearly. The two selector parts 41, 46, do not necessarily have to be arranged linearly, but they can also be arranged, for instance, circularly, divided into a plurality of levels. The first selector part 41 has step contacts 44 that are electrically conductively connected with the even-numbered winding taps 23 of the regulating winding 21 of the first winding 20. The second selector part 46 has step contacts 49 that are electrically conductively connected with the odd-numbered winding taps 33 of the regulating winding 31 of the second winding 30.

The first selector part 41 moreover has a first dissipation rail 51 and a second dissipation rail 52. The second selector part 46 likewise has a first dissipation rail 53 and a second dissipation rail 54. Arranged between each dissipation rail 51, 52, 53, 54 and the step contacts 44, 49 is a respective selector arm 42, 43, 47, 48 that establishes an electrically conductive connection between an even-numbered or odd-numbered winding tap 23, 33 and an assigned dissipation rail 51, 52, 53, 54. In addition, the dissipation rails 51, 52, 53, 54 are electrically conductively connected with the load-diverter switch 60.

The load-diverter switch 60 consists of a first and a second switching side 60A, 60B that can be either opened or closed, and thus can conduct or interrupt a current I. These states are indicated in this view by simple, individual switch symbols; they can, however, be constructed of a plurality of switching means connected in parallel and in series.

The load-diverter switch 60 can be formed in any manner as required, for instance according to one of the embodiments described in the following passages by means of FIGS. 3 and 5 to 7.

In the position shown in FIG. 1, the individual step contacts 44, 49 of the first and the second selector part 41, 46, and thus also the first and the second winding 20, 30, are conductively connected with each other. In this instance, a step contact 44 with the number 6 is connected via the second selector arm 43 with the second dissipation rail 52 of the first selector part 41. Since the second switching side 60B is closed, the second dissipation rail 52 of the first selector part 41 is connected with the first dissipation rail 53 of the second selector part 46. Here, an electrically conductive connection exists between the first dissipation rail 53 and the step contact 49 with the number 5 via the first selector arm 47. Since the first switching side 60A is opened, the first dissipation rail 51 of the first selector part 41 and the second dissipation rail 54 of the second selector part 46 are disconnected from each other.

The procedure of a switching for voltage regulation in the tapped transformer 15 of FIG. 1 is illustrated in FIGS. 2*a* to 2*g*.

Figure 2A:
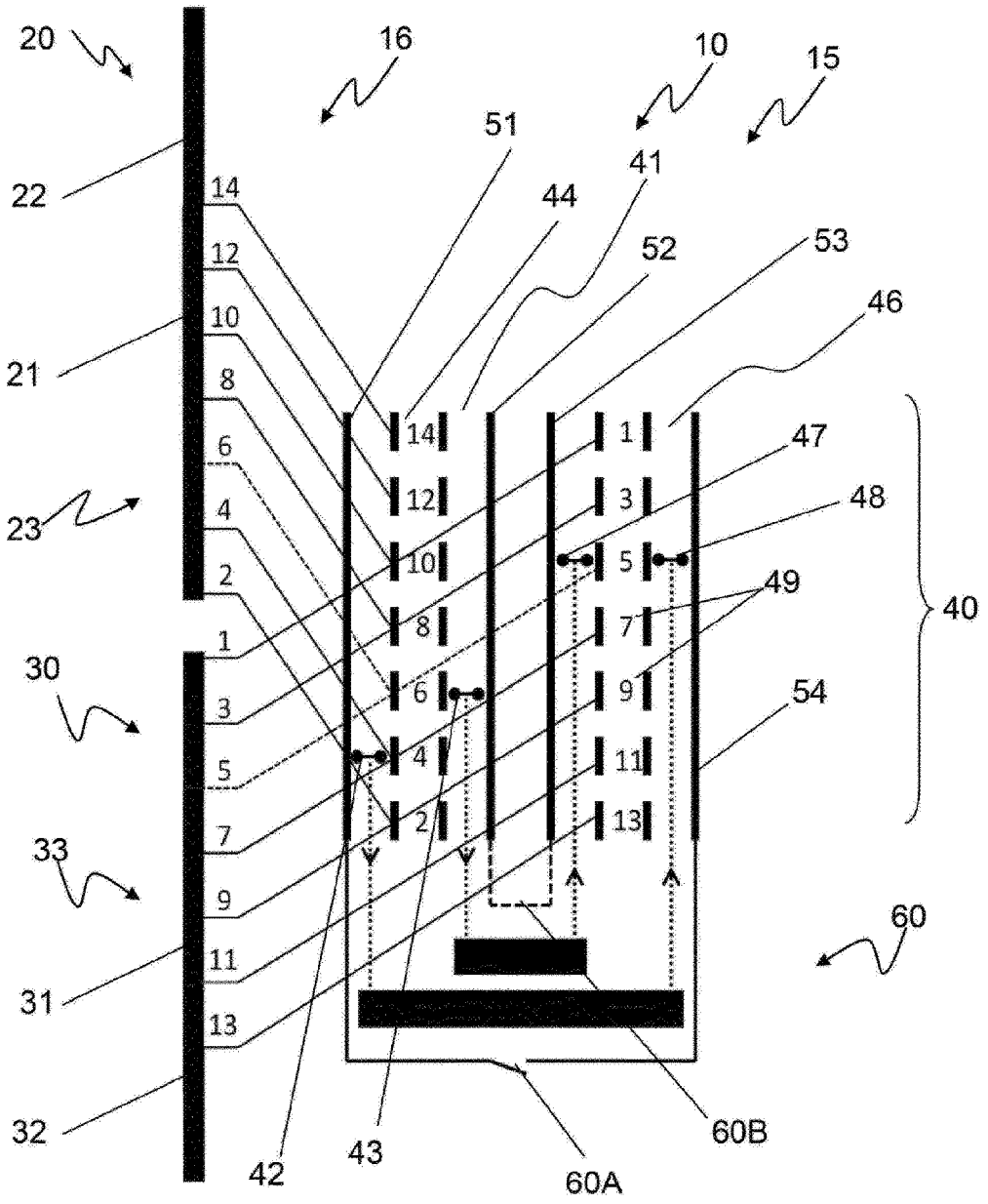
FIGS. 2*a*-2*g* show the procedure of a switching in the tapped transformer for voltage regulation of FIG. 1.
Figure 2B:
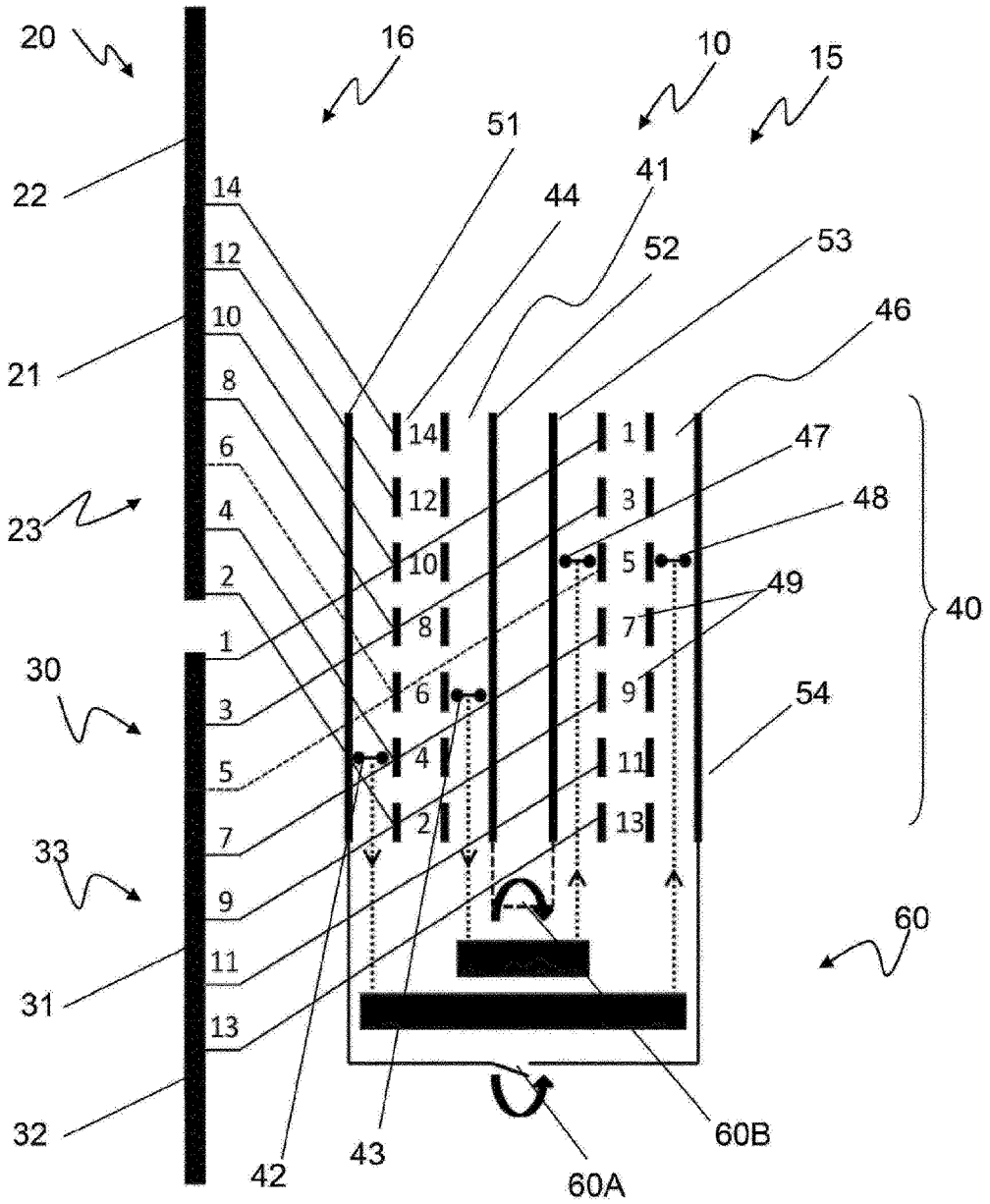

FIG. 2*a* illustrates the current flowing from the main winding 22 of the first winding 20 up to the even-numbered winding tap 23 with the number 6 of the regulating winding 21 to the step contact 44 with the number 6 of the first selector part 41. As the second switching side 60B is conductive, the current flows from the step contact 44 with the number 6 via the second selector arm 43 to the second dissipation rail 52 and thus to the second switching side 60B. After that, the second switching side 60B connects the second dissipation rail 52 of the first selector part 41 via the first dissipation rail 53 of the second selector part 46 and its selector arm 47 with the step contact 49 with the number 5. The step contact 49 is connected with the odd-numbered winding tap 33 with the number 5 of the second winding 30.

Figure 2C:
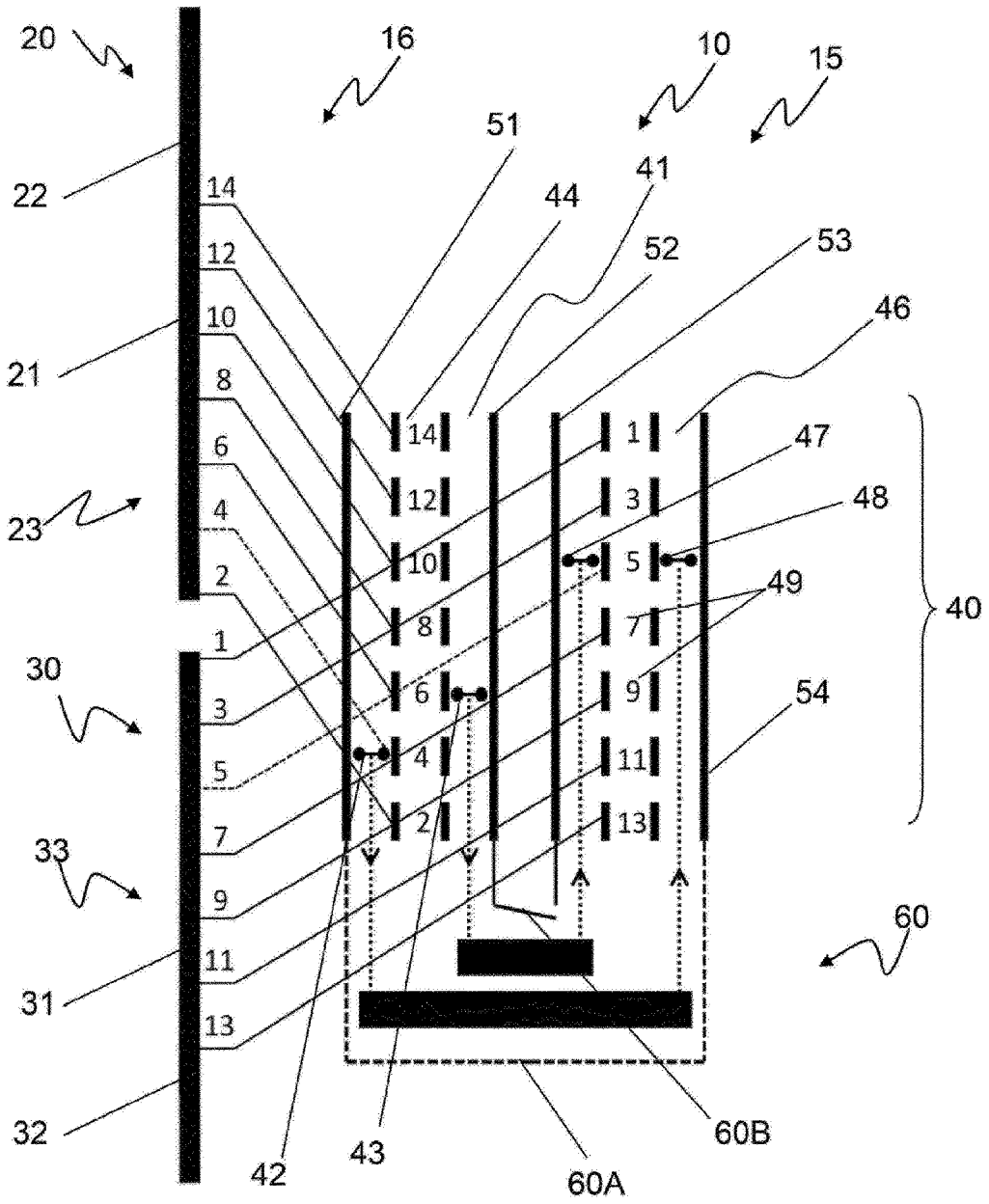

In order to be able to connect an even-numbered winding tap 22 of the first winding 20, the first selector arm 42 of the first selector part 41 is first moved power-free to the next step contact 44 to be switched with the number 4 of the first selector part 41 and the second selector arm 48 of the second selector part 46 is moved to the step contact 49 with the number 5 already contacted by the first selector arm 47 of the second selector part 46. By a suitable switching sequence or activation sequence (FIG. 4) of the switching means of the load-diverter switch 60, the switching side 60A is now closed and the switching side 60B is opened. The exact designs of possible load-diverter switches 60 as well as their activation sequences will be explained by means of FIGS. 3 to 7. Thus, a conductive connection is established from the even-numbered winding tap 23 with the number 4 via the step contact 44 with the number 4 of the first selector part 41, the first selector arm 42, the first dissipation rail 51, the first switching branch 60A, the second dissipation rail 54 of the second selector part 46, the second selector arm 48 and the step contact 49 with the number 5 connected with the odd-numbered winding tap 33 with the number 5, as is illustrated in FIG. 2*c*.

Figure 2D:
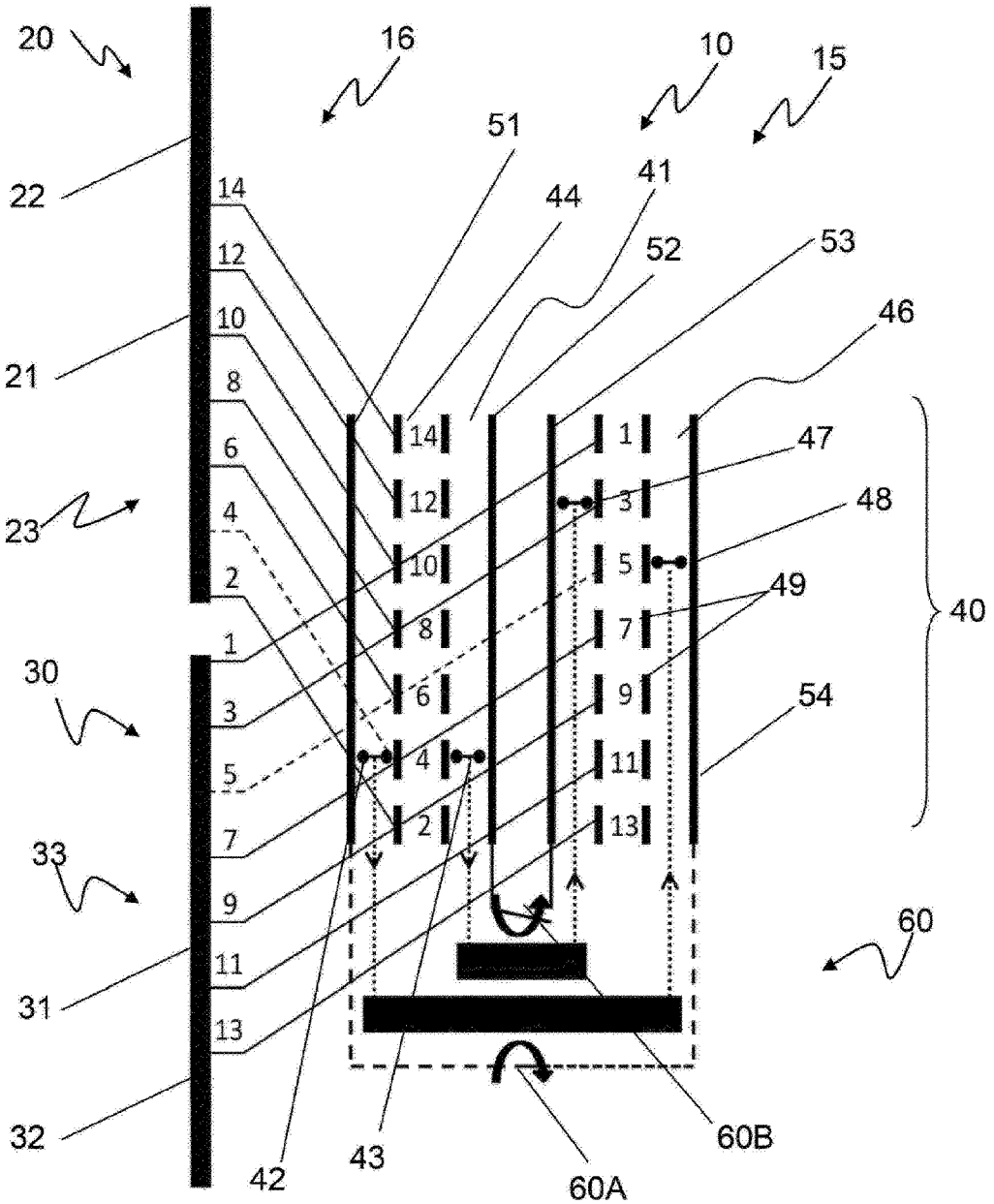
Figure 2E:
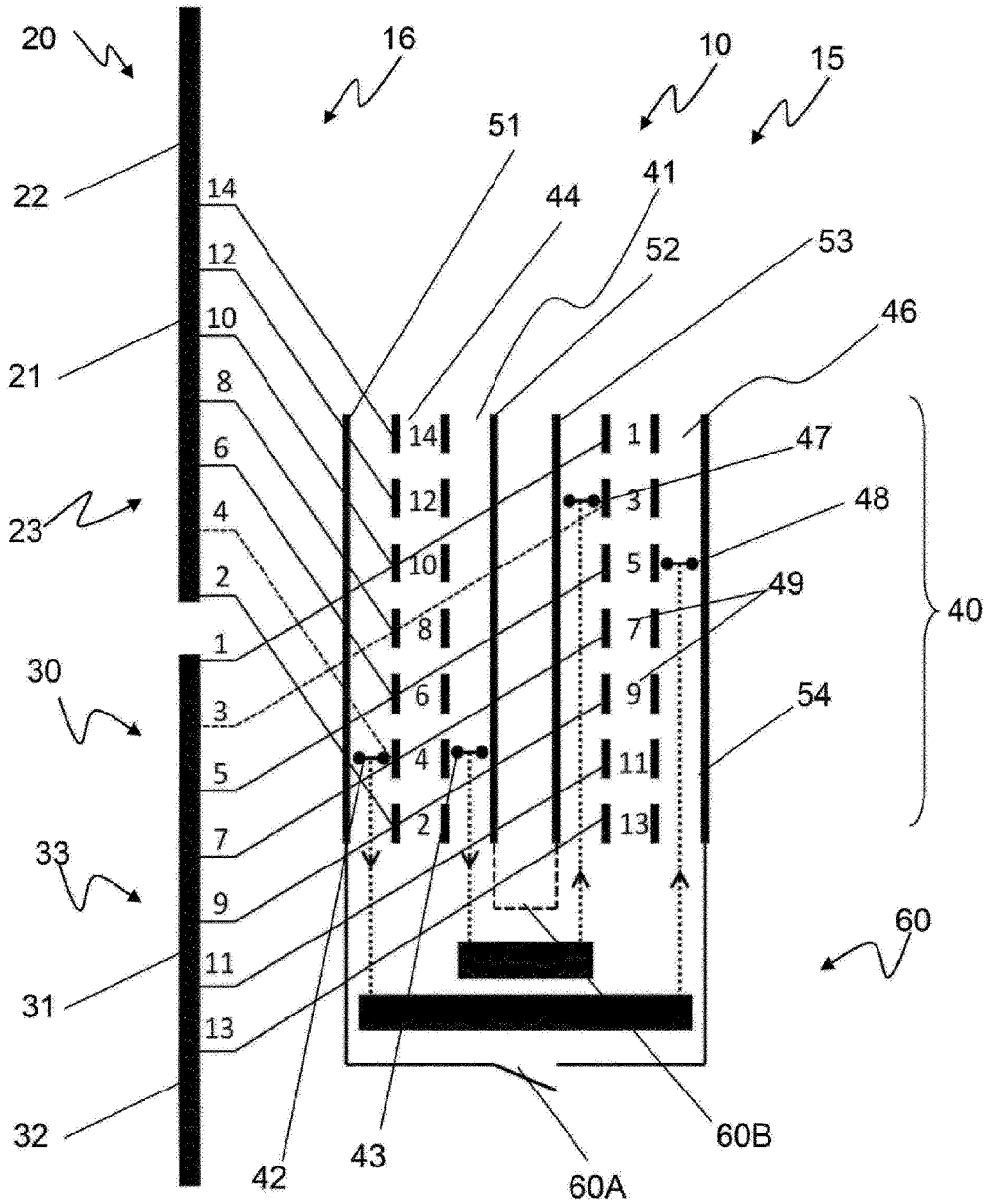

If another winding tap is to be connected, as in FIG. 2*d*, an odd-numbered winding tap 33 of the regulating winding 31 is used for this purpose. The second selector arm 43 of the first selector part 41 then moves to the step contact 44 with the number 4 already preselected by the first selector arm 42, which step contact 44 is already connected with the corresponding even-numbered winding tap 23. In addition, the first selector arm 47 of the second selector part 46 moves to the next step contact 49 with the number 3 to be switched. The second switching side 60B is subsequently closed and the first switching side 60A is opened by the appropriate activation of the switching means of the load-diverter switch 60. As can be seen in FIG. 2*e*, an odd-numbered winding tap 33 is thus connected and the first winding 20 and the second winding 30 are connected with each other via the switching side 60B.

Figure 2F:
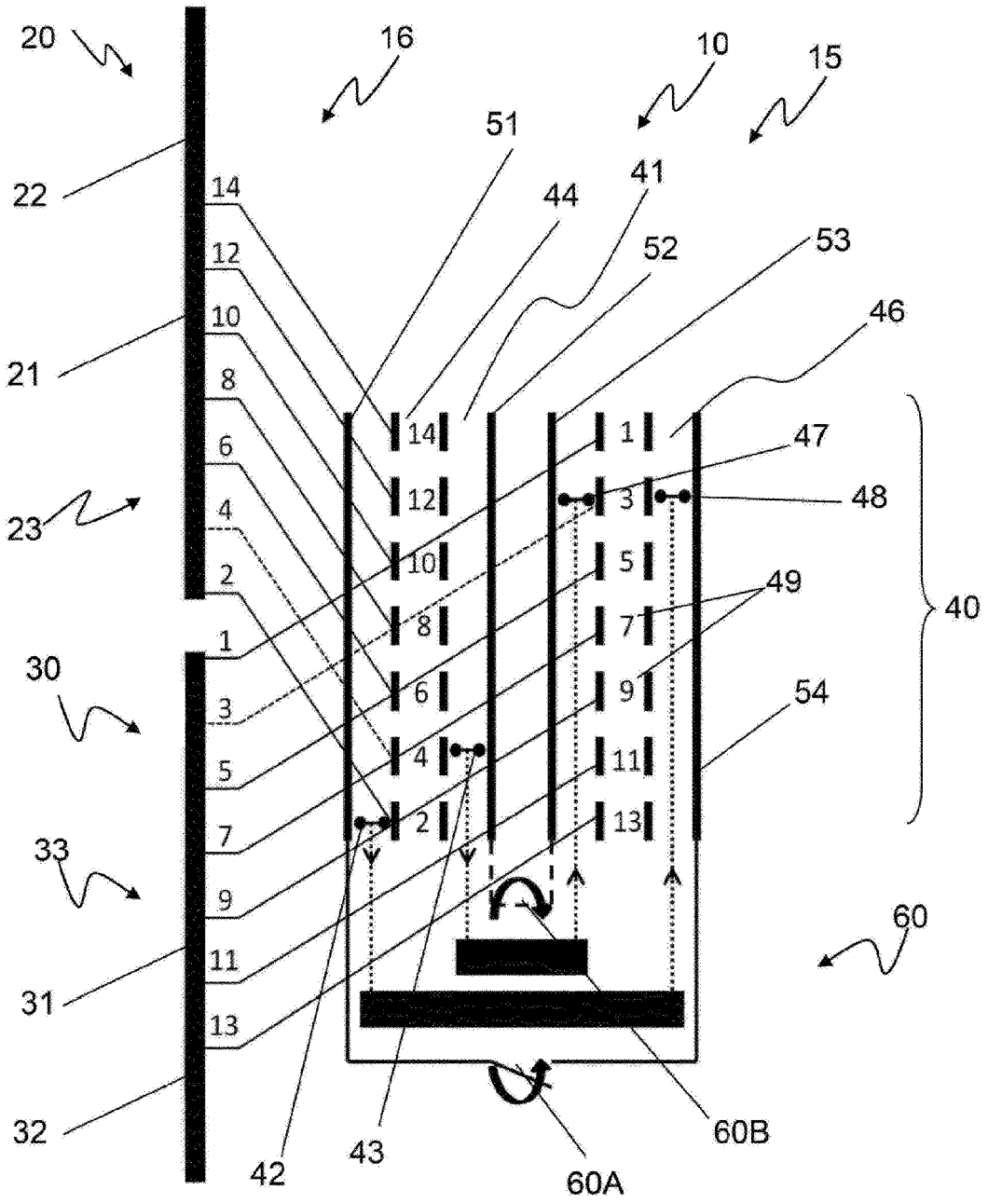
Figure 2Q:
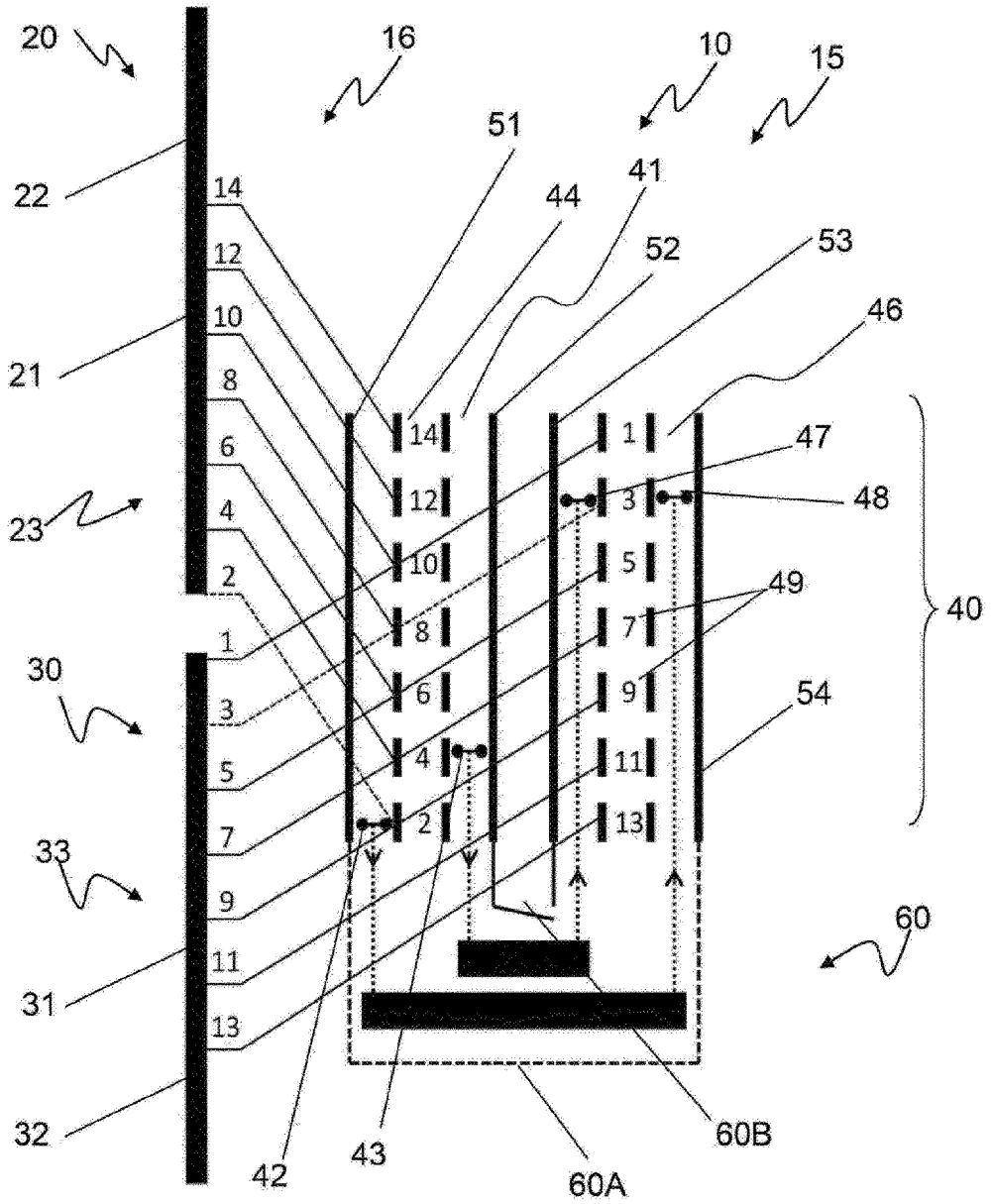

An even-numbered winding tap 23 is then reverted to for the next switching of a winding tap, as is illustrated in FIG. 2*f*. The first selector arm 42 of the first selector part 41 then selects the next step contact 44 connected with the even-numbered winding tap 23 of the regulating winding 21 of the first winding 20. In addition, the second selector arm 48 preselects the step contact 49, to which the first selector arm 47 has already moved. By opening the second switching side 60B and closing the first switching side 60A, the last even-numbered winding tap 23 is connected, as can be seen in FIG. 2*g*. In general, connecting or disconnecting is always performed by alternating between the even-numbered and the odd-numbered winding taps 23, 33.

Figure 3:
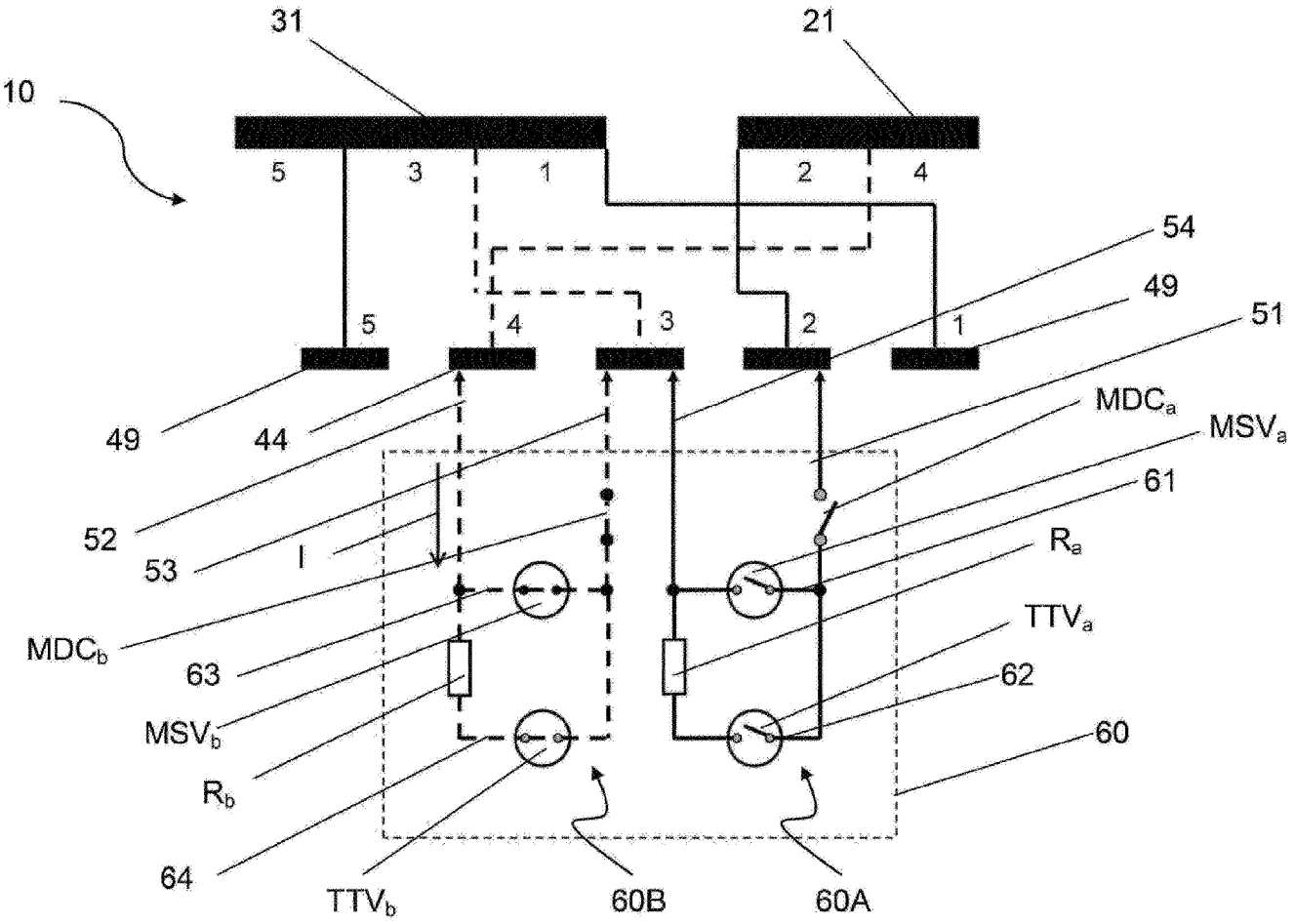
FIG. 3 shows a first embodiment of a load-diverter switch for an on-load tap changer.

In FIG. 3, a first embodiment of a load-diverter switch 60 for an on-load tap changer 10 is represented formed, for instance, according to the first embodiment. It has a first switching side 60A and a second switching side 60B. In a closed state, the first switching side 60A connects the first dissipation rail 51 of the first selector part 41 and the second dissipation rail 54 of the second selector part 46. The second switching side 60B in a closed state connects the first dissipation rail 53 of the second selector part 46 and the second dissipation rail 52 of the first selector part 41. Both switching sides 60A, 60B have a first switching branch and a second switching branch 61, 62, 63, 64 that are arranged in parallel to each other. A vacuum switching tube $MSV_a$ or $MSV_b$ is arranged to function as a main contact in each first switching branch 61, 63. Arranged in each second switching branch 62, 64 and connected in series are a vacuum switching tube $TTV_a$ or $TTV_b$ that functions as a resistance contact, and a respective resistor $R_a$ or $R_b$. A mechanical switch $MDC_a$ or $MDC_b$ is formed upstream of the switching branches 61, 62, 63, 64 as a disconnecting switch. The disconnecting switches not only serve for commutation, but also for disconnecting, i.e. for the galvanic isolation of the load branch not conducting the load current. In this embodiment, the resistors Ra, $R_b$ are formed as cast iron resistors.

Figure 4:
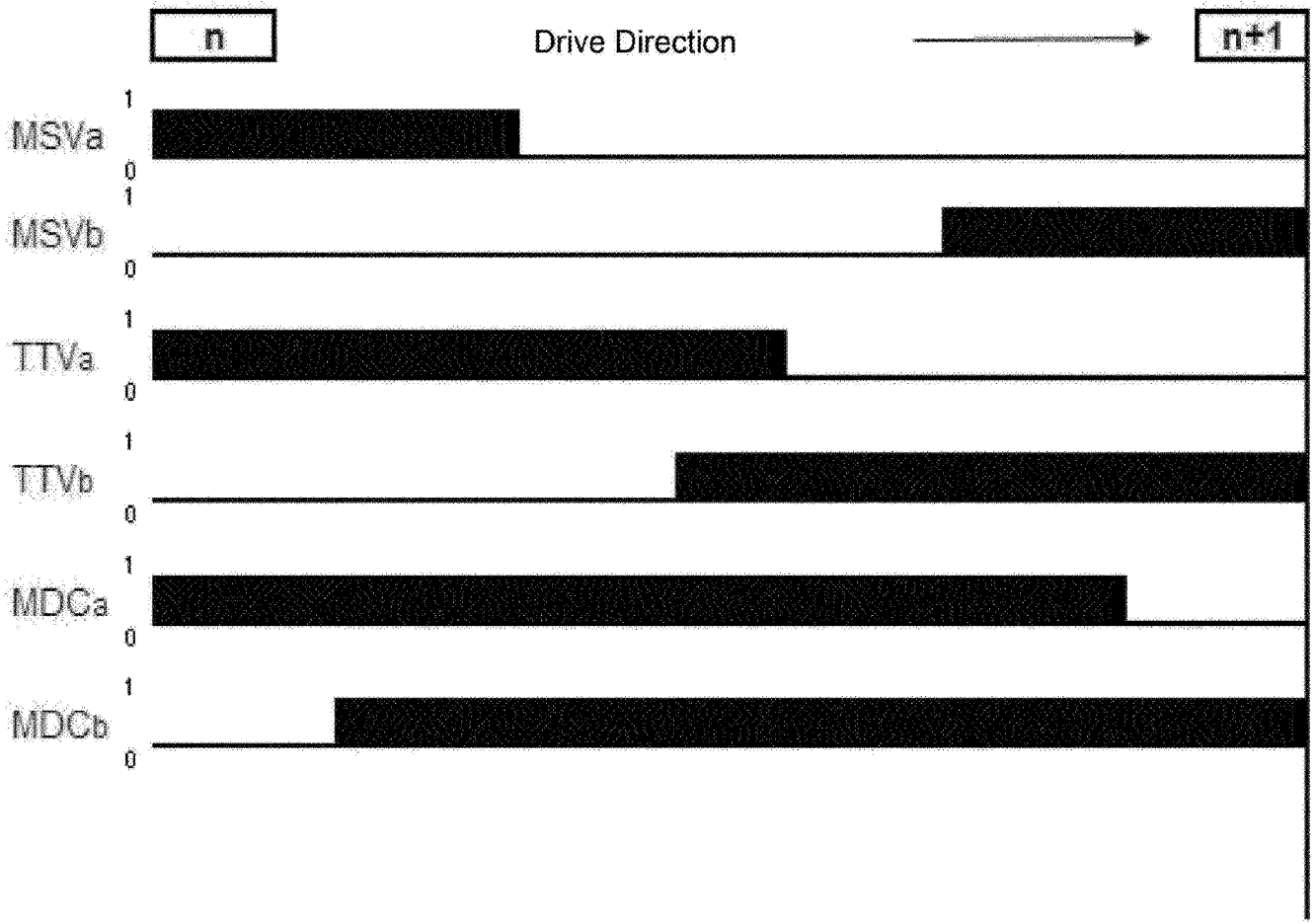
FIG. 4. shows an activation sequence of the load-diverter switch of FIG. 3.

FIG. 4 shows an activation sequence of the load-diverter switch 60 represented in FIG. 3 after the selection process by the first and second selector parts 41, 46. The switching in the load-diverter switch 60 is performed in the following steps:

$MDC_b$ closes
$MSV_a$ opens
$TTV_b$ closes
$TTV_a$ opens
$MSV_b$ closes
$MDC_a$ opens; the switching is concluded.

Figure 5:
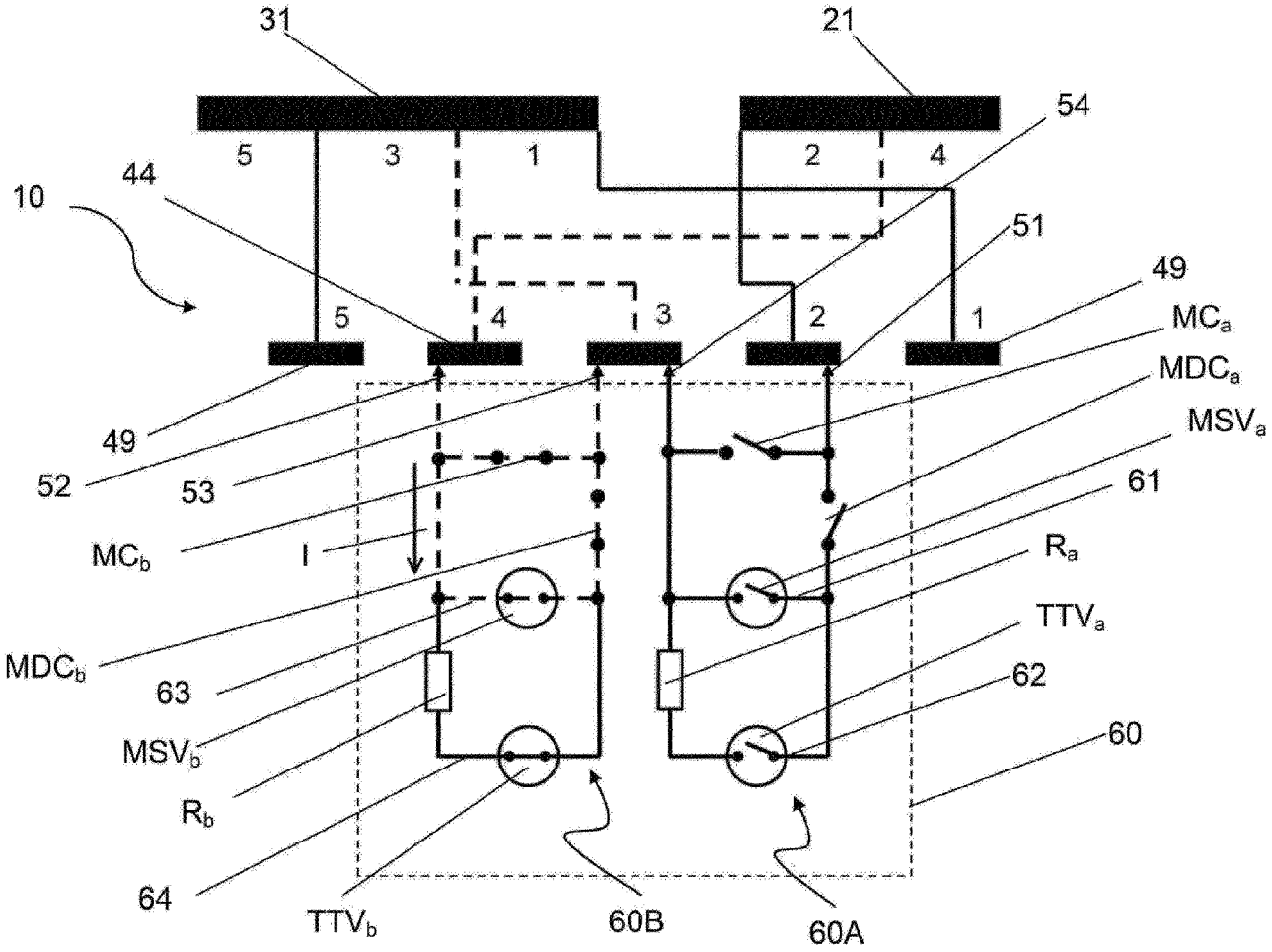
FIG. 5 shows a second embodiment of the load-diverter switch.
Figure 6:
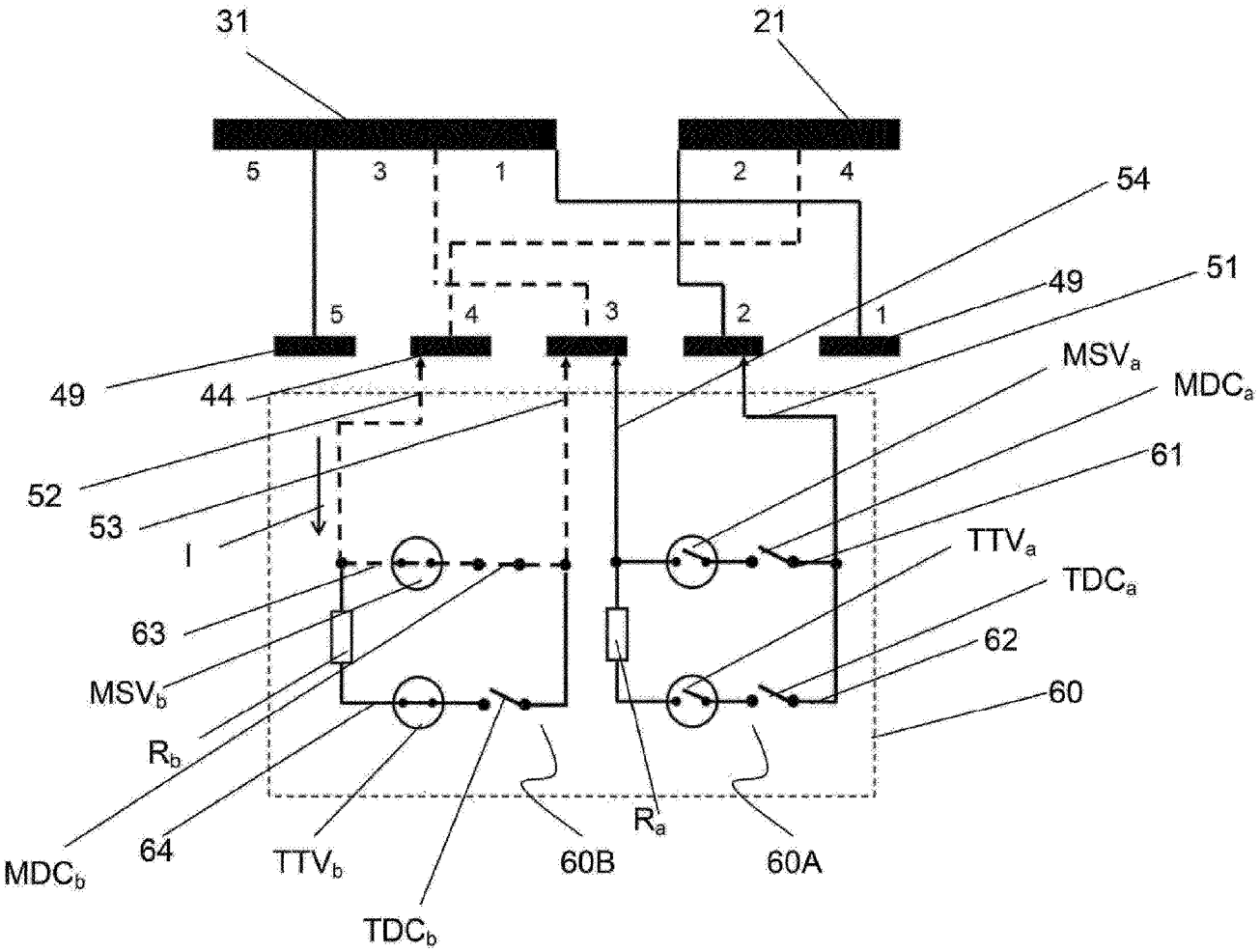
FIG. 6 shows a third embodiment of the load-diverter switch.

FIG. 5 shows a second embodiment of a load-diverter switch 60 for an on-load tap changer 10. As this embodiment is similar to the first embodiment, primarily the differences will be explained in more detail in the following passages.

In this embodiment, additional permanent main contacts $MC_a$ or $MC_b$ are provided in both switching sides 60A, 60B, which permanent main contacts $MC_a$ or $MC_b$ in an in itself known manner, carry the continuous current during stationary operation and relieve the respective vacuum switching tube $MSV_a$ or $MSV_b$ which functions as main contact. Such an additional arrangement of permanent main contacts $MC_a$ or $MC_b$ is of course also possible in the context of the invention in the further explained embodiments of the invention. The sequence for activating the individual vacuum switching tubes and the mechanical switches can be freely defined.

FIG. 5 shows a second embodiment of a load-diverter switch 60 for an on-load tap changer 10. As this embodiment is similar to the first embodiment, primarily the differences will be explained in more detail in the following passages.

Other than in the first embodiment in FIG. 3, the mechanical switch $MDC_a$ or $MDC_b$ is arranged in series with the vacuum switching tube $MSV_a$ or $MSV_b$ in the first switching branches 61, 63, and a second mechanical switch TDCa or TDCb is additionally arranged in series with the vacuum switching tube $TTV_a$ or $TTV_b$ in the second switching branches 62, 64. The sequence for activating the individual vacuum switching tubes and the mechanical switches can be freely defined.

Figure 7:
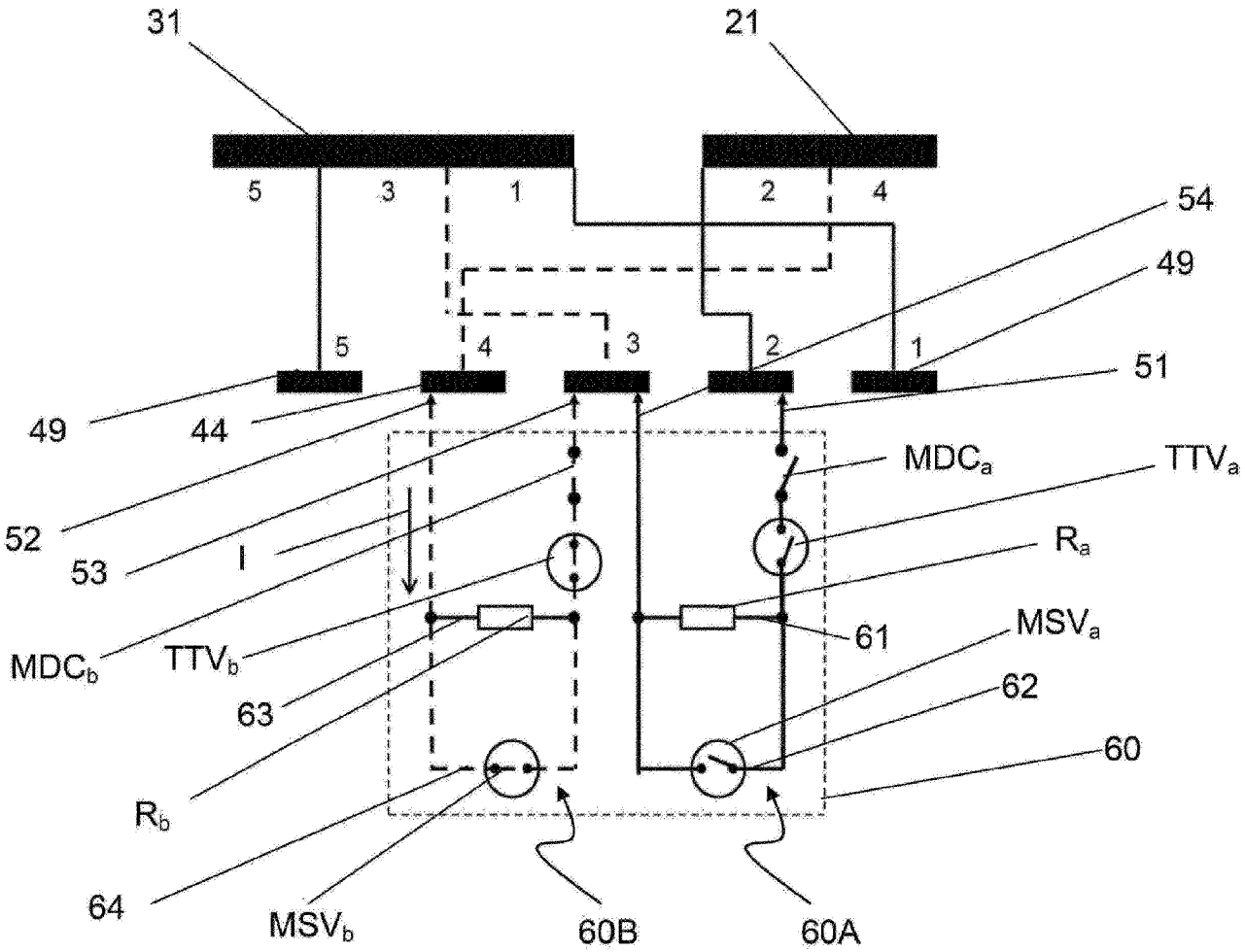
FIG. 7 shows a fourth embodiment of the load-diverter switch.

FIG. 7 shows a fourth embodiment of a load-diverter switch 60 for an on-load tap changer 10. As this embodiment is similar to the first embodiment, primarily the differences will be explained in more detail in the following passages.

In this embodiment, a resistor Ra, $R_b$ is arranged in each first switching branch 61, 63, and a vacuum switching tube $MSV_a$, $MSV_b$ is arranged in each second switching branch 62, 64. Connected in series upstream of the switching branches 61, 62, 63, 64, are a mechanical switch $MDC_a$, $MDC_b$ as a disconnecting switch and vacuum switching tubes $TTV_a$, $TTV_b$ functioning as resistance contacts. The sequence for activating the individual vacuum switching tubes and the mechanical switches can be freely defined.

Figure 8:
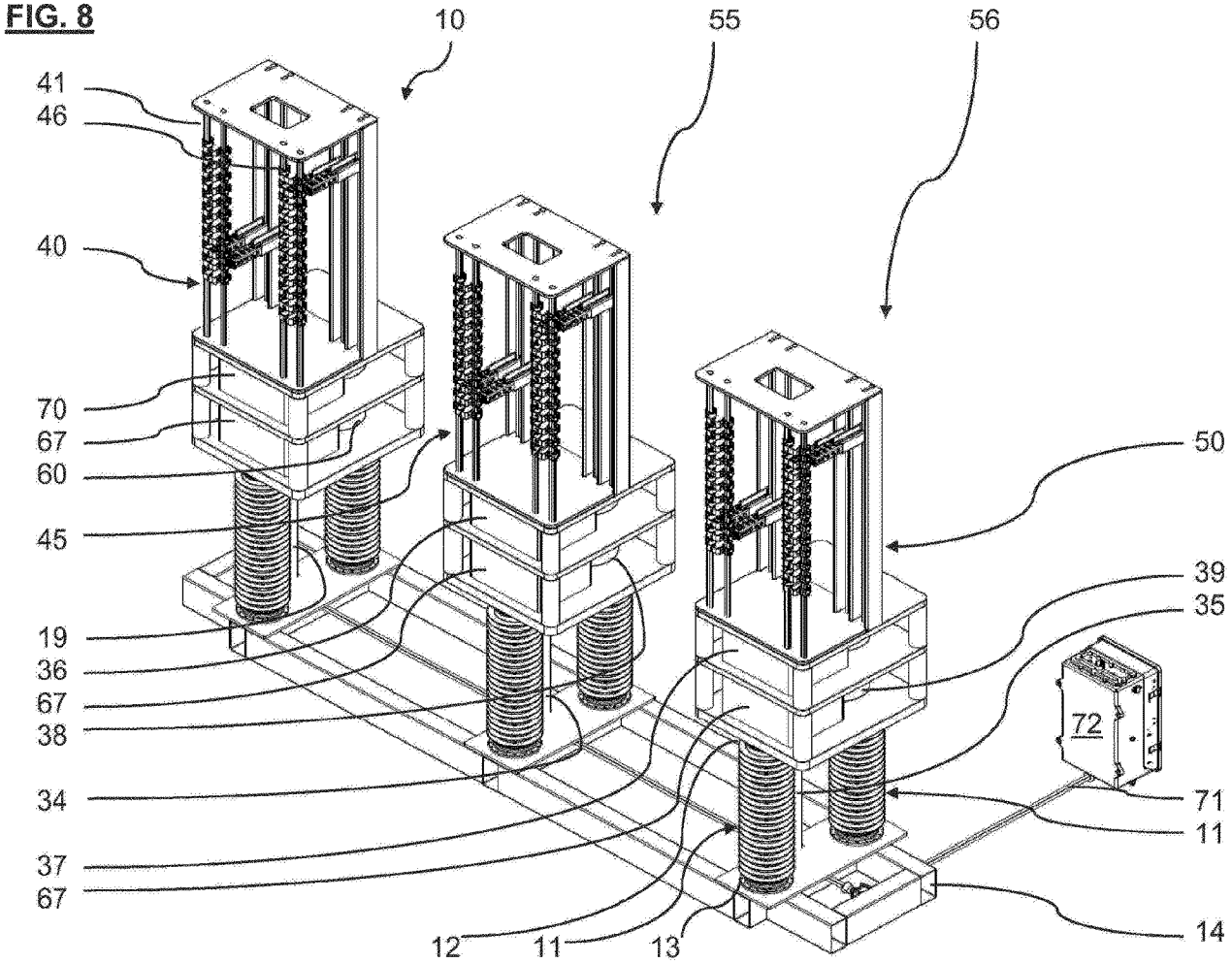
FIG. 8 shows a construction design of three on-load tap changers according to a second embodiment.

FIG. 8 shows three on-load tap changers, namely a first on-load tap changer 10, a second on-load tap changer 55, and a third on-load tap changer 56 in a second embodiment, which are used for a three-phase tapped transformer 15. As this embodiment is similar to the first embodiment, primarily the differences will be explained in more detail in the following passages.

In each on-load tap changer 10, 55, 56 in this embodiment, the first and the second selector part 41, 46 of the respective selector (see FIG. 9), namely of the first selector 40, of the second selector 45, and of the third selector 50, are driven by a transmission mounted immediately thereunder, namely by a first transmission 70, by a second transmission 36, and by a third transmission 37. Resistors 67 of the two switching sides 60A, 60B are arranged under each transmission 70, 36, 37. A respective load-diverter switch, namely a first load-diverter switch 60, a second load-diverter switch 38, and a third load-diverter switch 39 also activated by the respective transmission 70, 36, 37, is mounted next to each transmission 70, 36, 37 and next to the respective resistors 67. All on-load tap changers 10, 55, 56 are connected with a common motor drive 72 by a common rod assembly 71.

In this embodiment, the resistors 67 are each formed as cast iron resistors and each comprise the resistors Ra, $R_b$ of the respective load-diverter switches 60, 38, 39. Here, each load-diverter switch 60, 38, 39 is exemplarily formed according to the first embodiment shown in FIG. 3; it can, however, also be formed according to the second embodiment shown in FIG. 5 or according to the third embodiment shown in FIG. 6 or according to the fourth embodiment shown in FIG. 7 or also in another manner as required.

In this embodiment, each on-load tap changer 10, 55, 56 comprises two electrically insulating posts 11, each with one upper post end 12 and one lower post end 13 fixed to a base 14 at ground potential. In this example, the base 14 is part of the tapped transformer 15, but it can also be part of at least one of the on-load tap changers 10, 55, 56. The selectors 40, 45, 50 are each fixed to the respective upper post ends 12 and arranged above the respective upper post ends 12. The load-diverter switches 60, 38, 39 are each fixed to the respective upper post ends 12 and arranged above the respective upper post ends 12 and below the respective selector 40, 45, 50. The transmissions 70, 36, 37 are each fixed to the respective upper post ends 12 and arranged above the respective upper post ends 12 and below the respective selector 40, 45, 50 and above the resistors 67.

In this embodiment, the rod assembly 71 comprises electrically insulating distribution shafts that essentially run horizontally from the motor drive 72 as far as to the base 14 and further in the base 14 as far as under the post 11 of the respective on-load tap changers 10, 55, 56, as well as for each on-load tap changer 10, 55, 56 an electrically insulating drive shaft, namely a first, a second, and a third drive shaft 19, 34, 35 that each run essentially vertically from the base 14 as far as to the respective transmission 70, 36, 37. Each drive shaft 19, 34, 35 is coupled in the base 14 to one of the distribution shafts on the one end, and to the respective transmission 70, 36, 37 on the other end. The drive shafts 19, 34, 35 here run between the two respective posts 11, but they can also run through one of the respective posts 11 from its lower post end 13 to its upper post end 12.

It is, however, also possible that the transmissions 70, 36, 37 are each fixed to the respective lower post ends 13 and arranged below the respective lower post ends 13, in particular in the base 14, and that the rod assembly 71 comprises an electrically insulating driven shaft for each on-load tap changer 10, 55, 56 instead of the drive shafts 19, 34, 35, which driven shafts are not illustrated here, and which each run essentially vertically from the respective transmission 70, 36, 37 to the respective selector 40, 45, 50 and to the respective load-diverter switch 60, 38, 39. Each transmission 70, 36, 37 is coupled to one of the distribution shafts in the base 14, and each driven shaft is coupled to the respective transmission 70, 36, 37 on the one end, and to the respective selector 40, 45, 50 and the respective load-diverter switch 60, 38, 39 on the other end. The driven shafts here run between the two respective posts 11, but they can also run through one of the respective posts 11 from its lower post end 13 to its upper post end 12.

Instead of the common motor drive 72, the distribution shafts, and the transmissions 70, 36, 37, it is, however, also possible that each on-load tap changer 10, 55, 56 comprises an own motor drive, which is not illustrated here, and which is fixed to the respective lower post ends 13 and arranged below the respective lower post ends 13, in particular in the base 14. Each driven shaft is coupled to the respective motor drive on the one end and to the respective selector 40, 45, 50 and the respective load-diverter switch 60, 38, 39 on the other end. A direct drive is thus established for each on-load tap changer 10, 55, 56. The motor drives are preferentially synchronized by mechanical and/or electronic coupling.

Figure 9:
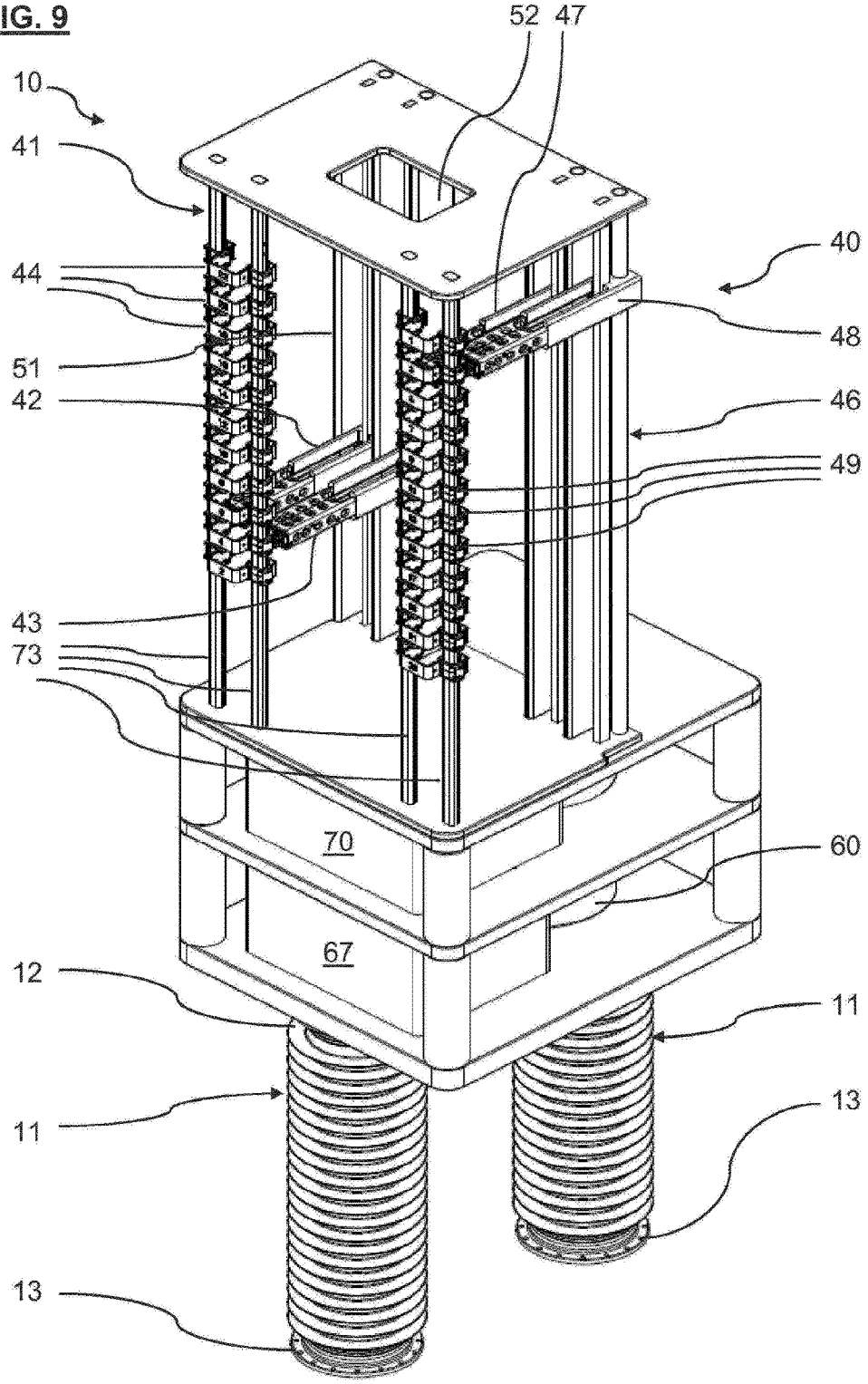
FIG. 9 shows a detailed view of the selector of one of the on-load tap changers of FIG. 8.

FIG. 9 shows a detailed view of the first on-load tap changer 10 from FIG. 8. The first and the second selector part 41, 46 are shown here. The step contacts 44, 49 that are contacted by the selector arms 42, 43, 47, 48, are mounted linearly in a vertical direction on insulation rods 73. The selector arms 42, 43, 47, 48 can be moved in a vertical direction by spindles or belts.

Figure 10:
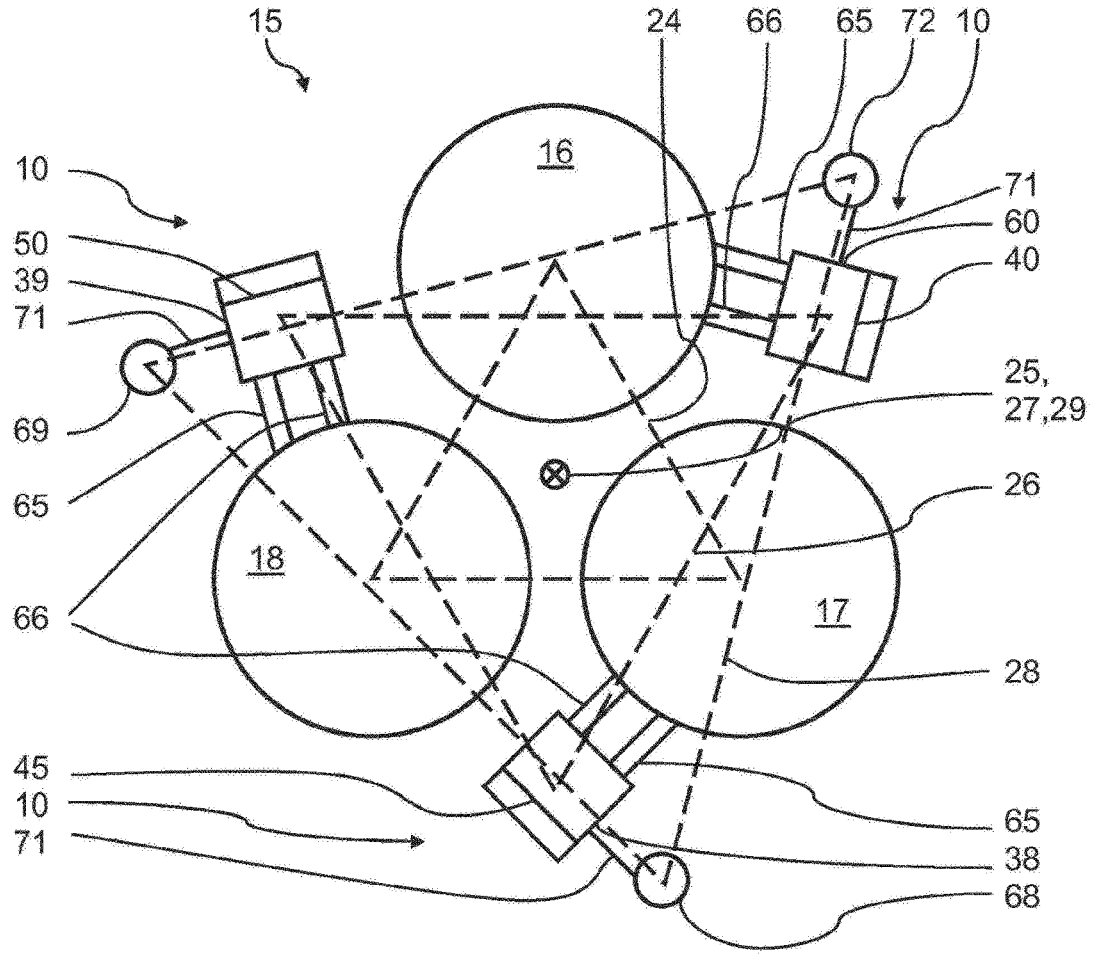
FIG. 10 shows a second embodiment of a tapped transformer with an on-load tap changer in a third embodiment.

A second embodiment of the tapped transformer 15 with an on-load tap changer 10 in a third embodiment is schematically illustrated in FIG. 10. This second embodiment of the tapped transformer 15 is similar to the first embodiment and this third embodiment of the on-load tap changer 10 is similar to the second embodiment so that primarily the differences will be explained in more detail in the following passages.

In this embodiment, the phases 16, 17, 18 of the tapped transformer 15 are arranged symmetrically to each other at the corners of a first equilateral triangle 24 with a symmetry axis 25 passing through its center of gravity, as in a temple-configuration transformer. The tapped transformer 15 comprises the one on-load tap changer 10 that is a three-phase on-load tap changer 10, for the three phases 16, 17, 18 together.

In this embodiment, the on-load tap changer 10 comprises a second selector 45 and a second load-diverter switch 38 for the second phase 17 and a third selector 50 and a third load-diverter switch 39 for the third phase 18. These two selectors 45, 50 are formed like the first selector 40, and these two load-diverter switches 38, 39 are formed like the first load-diverter switch 60. The selectors 40, 45, 50 and the load-diverter switches 60, 38, 39 are exemplarily arranged symmetrically to each other at the corners of a second equilateral triangle 26 with a symmetry axis 27 passing through its center of gravity.

For each phase 16, 17, 18, the on-load tap changer 10 in this embodiment comprises a motor drive, namely a first motor drive 72, a second motor drive 68, and a third motor drive 69 that are each coupled to the respective selector 40, 45, 50 and to the respective load-diverter switch 60, 38, 39 via a rod assembly 71. The motor drives 72, 68, 69 are exemplarily arranged symmetrically to each other in/at the corners of a third equilateral triangle 28 with a symmetry axis 29 passing through its center of gravity. They can also, however, be set under the respective selectors 40, 45, 50 and the respective load-diverter switches 60, 38, 39, for instance, and thus be arranged in/at the corners of the second equilateral triangle 26.

The symmetry axes 25, 27, 29 are coaxial to one another.

For each phase 16, 17, 18, the tapped transformer 15 comprises connecting lines 65 that electrically conductively connect the step contacts 44 of the first selector part 41 of the respective selector 40, 45, 50 with the even-numbered winding taps 23 of the regulating winding 21 of the respective first winding 20, and connecting lines 66 that electrically conductively connect the step contacts 49 of the second selector part 46 of the respective selector 40, 45, 50 with the odd-numbered winding taps 33 of the regulating winding 31 of the respective second winding 30.

The invention claimed is:

1. An on-load tap changer for controlling voltage of a tapped transformer wherein the tapped transformer has at least one regulatable phase that has a first winding and a second winding;

the first winding has a regulating winding with even-numbered winding taps identified with even numbers and a main winding;

the second winding has a regulating winding with odd-numbered winding taps identified with odd numbers and a main winding;

the first winding and the second winding are inductively coupled;

the on-load tap changer has a selector for the alternating power-free preselection of the even-numbered or odd-numbered winding taps to be switched;

the selector has a first selector part for the regulating winding with the even-numbered winding taps and a second selector part for the regulating winding with the odd-numbered winding taps for the power-free preselection of the winding taps to be switched;

the first selector part has first and second selector arms for the even-numbered winding taps;

the second selector part has first and second selector arms for the odd-numbered winding taps;

the first selector part is electrically conductively connected with the even-numbered winding taps of the regulating winding of the first winding via step contacts;

the second selector part is electrically conductively connected with the odd-numbered winding taps of the regulating winding of the second winding via step contacts;

each regulating winding has a respective dissipation rail;

each selector arm is electrically conductively connected with the respective dissipation rail and with the respective step contact of the corresponding regulating winding; and each dissipation rail is electrically conductively connected with a load-diverter switch between the even-numbered or the odd-numbered winding taps of the regulating windings.

2. The on-load tap changer according to claim 1, the tap changer comprising:

a load-diverter switch for switching between the even-numbered or the odd-numbered winding taps of the regulating windings preselected load-free by the selector.

3. The on-load tap changer according to claim 1, wherein the first selector arm of the first selector part is mechanically coupled to the second selector arm of the second selector part; and the first selector arm of the second selector part is mechanically coupled to the second selector arm of the first selector part.

4. The on-load tap changer according to claim 1, wherein the first selector arm of the first selector part can move independently of the second selector arm of the first selector part; and the first selector arm of the second selector part can moved independently of the second selector arm of the second selector part.

5. The on-load tap changer according to claim 1, wherein the first selector arm of the first selector part can moved independently of the first selector arm of the second selector part; and the second selector arm of the first selector part can moved independently of the second selector arm of the second selector part.

6. The on-load tap changer according to claim 1, wherein the step contacts connected with the even-numbered winding taps are in a vertical row;

the step contacts connected with the odd-numbered winding taps are in a vertical row; and the selector arms can be moved linearly vertically.

7. The on-load tap changer according to claim 1, wherein the load-diverter switch has a first switching side and a second switching side;

the first switching side disconnects or connects the first dissipation rail of the first selector part and the second dissipation rail of the second selector part; and the second switching side disconnects or connects the second dissipation rail of the first selector part and the first dissipation rail of the second selector part.

8. The on-load tap changer according to claim 7, wherein each switching side has at least one mechanical switch, two vacuum switching tubes, and one resistor; and each mechanical switch is connected in series with a first switching branch with a vacuum switching tube and with a parallel second switching branch with a vacuum switching tube and a resistor connected in series therewith.

9. The on-load tap changer according to claim 8, wherein each switching side has a permanent main contact connected in parallel to the first and second switching branch.

10. The on-load tap changer according to the claim 7, wherein each switching side has at least one mechanical switch, two vacuum switching tubes, and one resistor;

a first switching branch is connected in parallel to a second switching branch;

the first switching branch has a mechanical switch and a vacuum switching tube connected in series; and the second switching branch has a mechanical switch, a vacuum switching tube, and a resistor connected in series.

11. The on-load tap changer according to claim 10, wherein each switching side has at least one mechanical switch, two vacuum switching tubes, and one resistor;

each mechanical switch is connected in series with a vacuum switching tube and is connected in series with a first switching branch with a resistor and with a second switching branch with a vacuum switching tube; and the first and the second switching branch are connected in parallel.

12. The on-load tap changer according to claim 7, wherein each switching side has a permanent main contact that directly conductively disconnects from each other or conductively connects with each other the first and the second dissipation rail.

13. The on-load tap changer according to claim 1, the tap changer comprising a motor drive coupled to the selector or to the load-diverter switch; or a driven shaft that couples the motor drive to the selector or to the load-diverter switch; or a transmission that couples the motor drive to the driven shaft or to the selector or to the load-diverter switch; or a drive shaft that couples the motor drive to the transmission.

14. The on-load tap changer according to claim 1, the tap changer comprising an electrically insulating post with an upper post end and a lower post end that can be fixed to a base at ground potential;

wherein the selector is fixed to the upper post end and arranged above the upper post end; or the load-diverter switch is fixed to the upper post end and arranged above the upper post end, in particular below the selector; or the transmission is fixed to the upper post end and arranged above the upper post end, in particular below the selector or above the resistors, or fixed to the lower post end and arranged below the lower post end, in particular in the base; or the motor drive is fixed to the lower post end and arranged below the lower post end; or the drive shaft or the driven shaft runs through the post from the lower post end to the upper post end.

15. The on-load tap changer according to claim 1 wherein each resistor is a cast iron resistor.

16. The on-load tap changer according to claim 1, the tap changer comprising a second selector for a second phase to be regulated of the tapped transformer;

a third selector for a third phase to be regulated of the tapped transformer;

a second load-diverter switch assigned to the second selector;

a third load-diverter switch assigned to the third selector;

wherein the selectors are arranged at corners of a triangle;

the motor drive is coupled to the second and the third selector or to the second and the third load-diverter switch.

17. A tapped transformer for voltage regulation that comprises an on-load tap changer according to claim 1, and that has at least one phase to be regulated that has one first winding and one second winding, wherein the first winding has a regulating winding with even-numbered winding taps and a main winding, and the second winding has a regulating winding with odd-numbered winding taps and a main winding;

the first winding and the second winding having the regulating windings of the even-numbered and of the odd-numbered winding taps, are inductively coupled;

the on-load tap changer has a first selector part and a second selector part for the alternating power-free preselection of the even-numbered or odd-numbered winding taps to be switched.

18. The tapped transformer according to claim 17, wherein the first selector part and the second selector part each have two selector arms for the winding taps of each one of the regulating windings;

each selector arm of the first or second selector part is electrically conductively connected with a respective dissipation rail and with a respective step contact of the corresponding regulating winding;

each dissipation rail is electrically conductively connected with the on-load tap changer.

19. The tapped transformer according to claim 17, further comprising:

a transmission with a motor drive for activating the first selector part and the second selector part.

20. The tapped transformer according to claim 17 wherein each on-load tap changer of each one of the phases is connected with a common motor drive.

21. The tapped transformer according to claim 17, the tapped transformer comprising a second and a third phase to be regulated;

wherein the phases are arranged symmetrically to each other at the corners of a first equilateral triangle;

the on-load tap changer comprises a second selector for the second phase;

a third selector for the third phase;

the selectors are arranged at the corners of a second triangle.

22. The tapped transformer according to claim 17, the tapped transformer comprising a second and a third phase to be regulated;

a second on-load tap changer for the second phase and a third on-load tap changer for the third phase;

wherein the phases are arranged symmetrically to each other at the corners of a first equilateral triangle;

the on-load tap changers are arranged at the corners of a second triangle.

23. The tapped transformer according to claim 17, the tapped transformer comprising a motor drive for each phase, which motor drive is coupled to the respective selector or to the respective load-diverter switch;

wherein the motor drives are arranged at the corners of a third triangle.

24. A method of switching a tapped transformer for voltage regulation, which tapped transformer is constituted according to claim 17, wherein the tapped transformer has a first winding and a second winding;

the first winding has a regulating winding with even-numbered winding taps identified with even numbers;

the second winding has a regulating winding with odd-numbered winding taps identified with odd numbers;

an even- or odd-numbered winding tap to be switch is preselected load-free by a single load-diverter switch.

25. The method according to claim 24, wherein the even-numbered or odd-numbered winding taps are preselected and switched alternatingly.

26. An on-load tap changer for controlling voltage of a tapped transformer wherein the tapped transformer has at least one regulatable phase that has a first winding and a second winding;

the first winding has a regulating winding with even-numbered winding taps identified with even numbers and a main winding;

the second winding has a regulating winding with odd-numbered winding taps identified with odd numbers and a main winding;

the first winding and the second winding are inductively coupled;

the on-load tap changer has a selector for the alternating power-free preselection of the even-numbered or odd-numbered winding taps to be switched a second selector for a second phase to be regulated of the tapped transformer;

a third selector for a third phase to be regulated of the tapped transformer;

a second load-diverter switch assigned to the second selector;

a third load-diverter switch assigned to the third selector;

a second driven shaft that couples the motor drive to the second selector or to the second load-diverter switch; or a third driven shaft that couples the motor drive to the third selector or to the third load-diverter switch; or a second transmission that couples the motor drive to the second driven shaft or to the second selector or to the second load-diverter switch; or a third transmission that couples the motor drive to the third driven shaft or to the third selector or to the third load-diverter switch; or a second drive shaft that couples the motor drive to the second transmission; or a third drive shaft that couples the motor drive to the third transmission;

wherein the selectors are arranged at corners of a triangle;

the motor drive is coupled to the second and the third selector or to the second and the third load-diverter switch.

27. An on-load tap changer for controlling voltage of a tapped transformer wherein the tapped transformer has at least one regulatable phase that has a first winding and a second winding;

the first winding has a regulating winding with even-numbered winding taps identified with even numbers and a main winding;

the second winding has a regulating winding with odd-numbered winding taps identified with odd numbers and a main winding;

the first winding and the second winding are inductively coupled;

the on-load tap changer has a selector for the alternating power-free preselection of the even-numbered or odd-numbered winding taps to be switched a second selector for a second phase to be regulated of the tapped transformer;

a third selector for a third phase to be regulated of the tapped transformer;

a second load-diverter switch assigned to the second selector;

a third load-diverter switch assigned to the third selector;

the tap changer comprising a second motor drive coupled to the second selector or to the second load-diverter switch;

a third motor drive coupled to the third selector or to the third load-diverter switch;

wherein the motor drives are synchronized by a mechanical or electronic coupling;

wherein the selectors are arranged at corners of a triangle;

the motor drive is coupled to the second and the third selector or to the second and the third load-diverter switch.

* * * * *